US010294714B2

(12) United States Patent
Massey

(10) Patent No.: US 10,294,714 B2
(45) Date of Patent: May 21, 2019

(54) FENESTRATION ASSEMBLY

(71) Applicant: Milgard Manufacturing Incorporated, Tacoma, WA (US)

(72) Inventor: Victor Massey, Orting, WA (US)

(73) Assignee: MILGARD MANUFACTURING INCORPORATED, Tacoma, WA (US)

( * ) Notice: Subject to any disclaimer, the term of this patent is extended or adjusted under 35 U.S.C. 154(b) by 13 days.

(21) Appl. No.: 15/147,161

(22) Filed: May 5, 2016

(65) Prior Publication Data

US 2016/0376835 A1 Dec. 29, 2016

Related U.S. Application Data

(60) Provisional application No. 62/184,032, filed on Jun. 24, 2015.

(51) Int. Cl.

| | |
|---|---|
| ***E06B 3/00*** | (2006.01) |
| ***E06B 7/16*** | (2006.01) |
| ***E06B 9/52*** | (2006.01) |
| ***E06B 3/58*** | (2006.01) |
| *E06B 3/54* | (2006.01) |
| *E06B 3/26* | (2006.01) |
| *E06B 3/70* | (2006.01) |

(52) U.S. Cl.

CPC ..... *E06B 7/16* (2013.01); *E06B 3/5878* (2013.01); *E06B 9/52* (2013.01); *E06B 3/5481* (2013.01); *E06B 2003/261* (2013.01); *E06B 2003/7048* (2013.01); *E06B 2009/527* (2013.01); *E06B 2009/528* (2013.01)

(58) Field of Classification Search

CPC . E06B 3/5878; E06B 9/52; E06B 7/16; E06B 2003/261; E06B 2003/7048; E06B 3/5481; E06B 2009/528; E06B 2009/527

USPC ..... 49/74.1, 61, 62, 63, 67, 501, 246

See application file for complete search history.

(56) References Cited

U.S. PATENT DOCUMENTS

| | | | |
|---|---|---|---|
| 1,178,219 | A | 4/1916 | Cramer |
| 1,813,475 | A | 7/1931 | Lawrence |
| 1,942,200 | A | 1/1934 | Brust |
| 2,544,512 | A | 3/1951 | Scruggs |
| 2,581,727 | A | 1/1952 | Soplata |
| 2,723,427 | A | 11/1955 | Babel |
| 2,778,100 | A | 1/1957 | Lipman |

(Continued)

FOREIGN PATENT DOCUMENTS

| | | | |
|---|---|---|---|
| DE | 19751114 | A1 | 5/1999 |
| EP | 0289568 | B1 | 2/1992 |

(Continued)

OTHER PUBLICATIONS

Detail 17.8.5 Alternative Window Sill Detail—Timber Frame Window; Hebel Commercial Website; URL: http://hebelcommercial.com.au/tag/hebel-prices/ ; Retrieved on May 4, 2016 via Google; Found on pp. 12-13 of 22 pages.

(Continued)

*Primary Examiner* — Jerry E Redman

(74) *Attorney, Agent, or Firm* — Rathe Lindenbaum LLP

(57) ABSTRACT

A fenestration assembly includes a frame assembly, and a sash assembly. The frame assembly includes at least one each unitary frame member formed from a first sheet of material. The sash assembly including at least one unitary member being formed from a second single sheet of material.

18 Claims, 31 Drawing Sheets

(56) References Cited

U.S. PATENT DOCUMENTS 3,293,817 A 12/1966 Macgregor
3,344,573 A 10/1967 Cole et al.
3,474,587 A 10/1969 Martin
3,606,419 A 9/1971 Vaughn et al.
3,803,779 A 4/1974 Dunsmoor et al.
3,987,835 A 10/1976 Bloomfield
4,145,858 A 3/1979 Dovman
4,335,552 A 6/1982 Blanchett et al.
4,387,542 A 6/1983 Wehr
4,409,758 A * 10/1983 Dickerson ..... E06B 3/28 160/231.2
4,457,110 A 7/1984 Beirnes
4,492,062 A 1/1985 Levenez
4,495,726 A * 1/1985 Lindstrom ..... E06B 3/26301 49/401
4,513,548 A * 4/1985 Parker ..... B60J 7/104 296/211
4,682,451 A 7/1987 Hubble
4,702,051 A 10/1987 Miller
4,742,664 A 5/1988 Johnson
4,783,938 A 11/1988 Palmer
4,970,840 A 11/1990 Ouellette et al.
4,974,364 A * 12/1990 Durham, Jr. ..... E06B 1/366 49/400
4,982,530 A * 1/1991 Palmer ..... E06B 3/26345 49/501
4,989,381 A * 2/1991 De Block ..... E06B 1/30 49/504
5,038,537 A 8/1991 Frambach
5,163,257 A 11/1992 Crowell
5,274,976 A 1/1994 Burkhart
5,315,798 A * 5/1994 Zarwell ..... E05D 1/00 454/225
5,321,921 A * 6/1994 Holt ..... E04C 3/02 52/288.1
5,491,940 A 2/1996 Bruchu
5,540,019 A 7/1996 Beske et al.
5,575,321 A * 11/1996 Currier ..... E06B 9/04 160/104
5,787,657 A 8/1998 Librande et al.
5,794,528 A * 8/1998 Gronig ..... B41F 15/36 101/127.1
5,836,119 A 11/1998 Emmanuel
5,918,417 A * 7/1999 Kinder ..... E06B 1/006 160/DIG. 16
5,950,379 A 9/1999 Moore et al.
6,076,314 A 6/2000 Simonton et al.
6,170,555 B1 1/2001 Welfonder
6,257,301 B1 * 7/2001 Conforti ..... E06B 9/26 160/84.01
6,263,632 B1 * 7/2001 Cadorette ..... E06B 7/086 403/331
6,276,099 B1 8/2001 O'Shea
6,293,064 B1 9/2001 Larson
6,334,283 B1 1/2002 Edger
6,341,447 B1 * 1/2002 Jean ..... E06B 7/082 160/84.07
6,347,492 B1 2/2002 Richardson
6,374,557 B1 4/2002 O'Donnell
6,385,925 B1 5/2002 Wark
6,729,082 B1 5/2004 Oldham
6,758,256 B1 * 7/2004 Garcia ..... E06B 7/086 160/134
6,789,359 B2 9/2004 Bauman et al.
6,928,776 B2 8/2005 Hornung
6,945,305 B1 9/2005 Limauro
6,991,693 B2 1/2006 Wylie et al.
7,036,280 B2 5/2006 Hogan
7,124,543 B2 10/2006 Chubb
7,266,929 B1 9/2007 Allred et al.
7,634,880 B2 12/2009 Sironko et al.
7,644,547 B2 1/2010 Bonshor
7,707,778 B2 5/2010 Petta et al.
7,836,562 B2 11/2010 Franklin et al.
7,861,473 B1 1/2011 Green
7,950,193 B1 5/2011 Plummer et al.
8,011,146 B2 9/2011 Krause
8,061,036 B1 11/2011 Plummer et al.
8,082,693 B2 * 12/2011 Marocco ..... E06B 7/086 49/403
8,141,833 B1 3/2012 Plummer et al.
8,266,851 B2 9/2012 Campbell et al.
8,353,138 B2 1/2013 Sigmund et al.
8,375,659 B2 2/2013 Bogenhagen et al.
8,484,902 B1 7/2013 Brown et al.
8,561,365 B2 10/2013 Albrecht et al.
8,584,410 B2 11/2013 Furgerson et al.
8,584,411 B2 11/2013 Mitchell
8,966,823 B1 3/2015 Camp
8,984,820 B1 3/2015 Kownacki et al.
9,631,415 B2 * 4/2017 Eisenbarth ..... E06B 3/302
2004/0188036 A1 9/2004 Hann
2004/0226220 A1 * 11/2004 Hsu ..... E06B 7/08 49/74.1
2005/0022452 A1 * 2/2005 Schlossbauer ..... E04B 2/88 49/67
2005/0115168 A1 6/2005 Bealko
2005/0178079 A1 8/2005 Hardman et al.
2006/0059800 A1 * 3/2006 Minter ..... E06B 1/12 52/204.5
2006/0248801 A1 * 11/2006 Marocco ..... E06B 7/086 49/74.1
2006/0288653 A1 12/2006 Mimnaugh
2007/0000195 A1 1/2007 Garces et al.
2007/0169427 A1 7/2007 Lee et al.
2008/0196342 A1 8/2008 Franklin
2008/0216424 A1 9/2008 Westphal et al.
2009/0293400 A1 * 12/2009 Fraser ..... E06B 9/28 52/473
2011/0083370 A1 * 4/2011 Stone ..... E06B 9/26 49/82.1
2011/0107695 A1 * 5/2011 Boldt ..... E06B 1/34 52/211
2014/0027074 A1 1/2014 Houlihan
2014/0041326 A1 2/2014 Kadavy et al.
2014/0230350 A1 8/2014 Poundstone
2014/0237918 A1 8/2014 Miller
2014/0260011 A1 9/2014 Pettibone
2014/0331576 A1 11/2014 Brown et al.
2015/0020465 A1 1/2015 Saunders et al.
2015/0033631 A1 * 2/2015 Asselin ..... E06B 7/12 49/67
2017/0145738 A1 * 5/2017 Marocco ..... E06B 9/264

FOREIGN PATENT DOCUMENTS

EP 0306129 B1 3/1992
EP 1201868 A1 5/2002
EP 1911923 A2 4/2008
EP 2696022 B1 11/2014
GB 739399 A 10/1953
GB 2287273 B 9/1995
GB 2353555 B 7/2003
GB 2421045 A 6/2006
GB 2515513 12/2014
WO 2010006626 A1 1/2010

OTHER PUBLICATIONS

Façade/Window Frame retrieved from MIT.edu via Google; URL: http://web.mit.edu/2.744/studentSubmissions/conceptRefinement/smokeandmirrors/ihb/ ; Received from Searcher on May 10, 2015; Search Report 1 page.

How To: Replacing Window Screens by Renovation Property Investments; https://renovationpropertyinvestments.wordpress.com/2012/08/16/how-to-replacing-window-screens/ ; Aug. 16, 2012; 9 pages.

(56) References Cited

OTHER PUBLICATIONS

The best way to create and organize your Revit Windows in your Project by Revit Content; http://www.revit-content.com/content/window/ ; Retrieved on May 4, 2016 via Google; 9 pages.

* cited by examiner

FENESTRATION ASSEMBLY

CROSS-REFERENCE TO RELATED PATENT APPLICATIONS

This application claims the benefit of U.S. Provisional Application No. 62/184,032 filed on Jun. 24, 2015 entitled Fenestration Assembly which is herein incorporated by reference in its entirety.

BACKGROUND

The present invention relates generally to the field of fenestration assemblies and more particularly to a fenestration assembly having an arcuate portion.

SUMMARY

A fenestration assembly includes a frame assembly, and a sash assembly. The frame assembly includes at least one unitary frame member formed from a first sheet of material. The sash assembly including at least one unitary member being formed from a second single sheet of material.

A process for forming a fenestration assembly providing a first sheet material and cutting the first sheet material to form a first unitary frame member; providing a second sheet material and cutting the second sheet material to form a second unitary frame member; providing a third sheet of material and cutting the third sheet material to form a first unitary sash member; providing a fourth sheet of material and cutting the fourth sheet material to form a first unitary sash member; routing the first unitary frame member with at least one feature; routing the first unitary sash member with at least one feature; operatively connecting the first unitary frame member to the second unitary frame member to form a frame assembly; and operatively connecting the first unitary sash member to the second unitary sash member to form a frame assembly.

In one embodiment a fenestration assembly includes a frame assembly, and a sash assembly. The frame assembly includes at least one each unitary frame member formed from a first sheet of material. The sash assembly includes at least one unitary member is formed from a second single sheet of material. A hinge operatively connects the sash assembly to the frame assembly to move the sash assembly from an open position relative to the frame to a closed position relative to the frame, the hinge is completely hidden when the sash is in the closed position. A weather strip is operatively secured to a groove in the unitary frame member, wherein the groove extends inwardly into the unitary frame member and continuously about an opening, the weather strip is positioned external to a glazing bead operatively coupled to the unitary sash member. A second unitary frame member includes grill integrally formed therein. An arcuate header includes an arcuate groove formed therein that removably receives an arcuate portion of a screen assembly, and at least one biasing member positioned within the groove to provide a biasing force to the screen assembly in an installed position, the header groove has a first depth proximate a center of the arcuate portion and a second depth a distance from the center of the arcuate portion, wherein the first depth is greater than the second depth. An inner sill member operatively connected to the frame assembly, the inner sill member includes a first upwardly extending slope region and a second downwardly extending slope region is separated by an apex, the screen assembly is moved up and over the apex from the first slope region to the second slope region and is held in the frame assembly by a biasing force of the biasing member. A glazing clip operatively secures a glazing assembly adjacent a first outer frame member relative to a second frame member. A screen assembly includes a screen frame and a screen mesh member connected to screen frame with a hook material operatively attached to the screen frame and fitting through a plurality of openings in the periphery of the screen mesh material. The unitary member of the sash assembly includes an outer face and an opposing inner face; a first periphery extends between the outer face and the inner face, and a second periphery spaced radially inwardly from the first periphery and defining an open region, a weep path extends from a second opening in the second periphery to a first opening in the first periphery; wherein the weep path is defined by a path extends from the second opening in the outer face toward the inner face; the path includes a first sloped region terminating in a bottom portion and a second portion extends from the bottom portion toward and terminating at the first opening in the first periphery; wherein water in the weep path remains in the region between the first region and the second region proximate the bottom portion. A second unitary sash member is removably coupled to the first unitary sash member with a hook and loop material.

DETAILED DESCRIPTION OF THE EXAMPLE EMBODIMENTS

Figure 1:
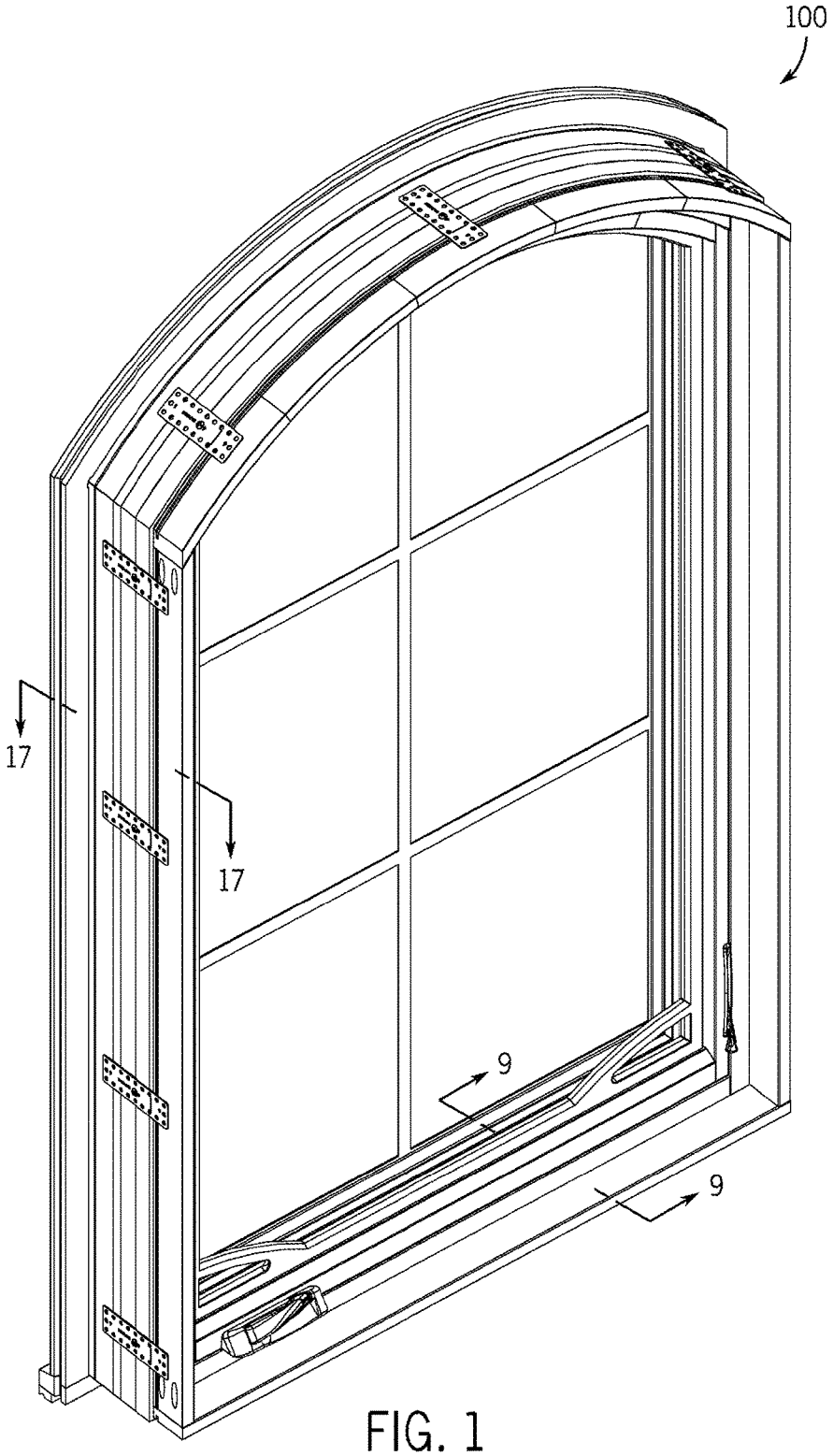
FIG. 1 is an isometric view of a fenestration assembly.
Figure 2:
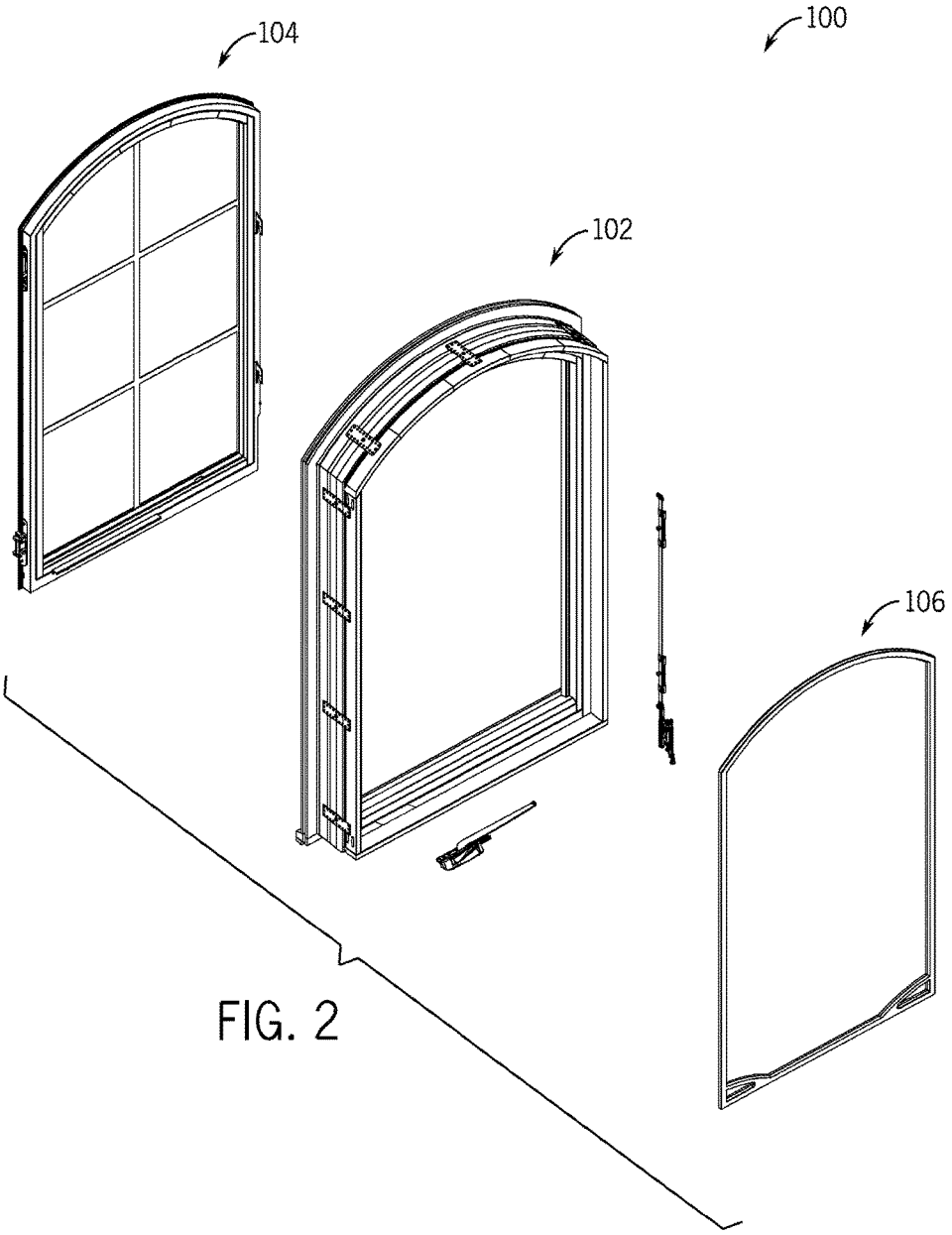
FIG. 2 is an exploded view of the fenestration assembly of FIG. 1.

Referring to FIG. 1 and FIG. 2 a fenestration assembly 100 includes a frame assembly 102 for an architectural element for a door or window in an opening of an architectural structure such as building. In one embodiment a movable element 104 is movably secured to frame 102. Movable element 104 may be a window sash assembly, a door or other type of fenestration structure.

To provide an orientation for discussion, the term outwardly direction will refer to the direction that faces away from the building structure that supports the fenestration assembly with a vector having a direction from the inside of the building structure toward the outside of the building structure. If a user is standing outside of a building and looking at the fenestration assembly the user would see the outwardly surfaces of the fenestration assembly. Similarly, if a person is standing inside of a building structure and looking at the fenestration assembly the user would see the inwardly surfaces of the fenestration assembly.

Unless otherwise indicated, the directions used herein reflect the orientation of a user facing the fenestration assembly from the interior of an enclosure or building structure. Inwardly includes the direction away from the window towards the user and the interior of an enclosure. The direction up and down includes the direction away from and toward the direction of gravity respectively. The left and right directions include the directions as viewed by a user facing the window or fenestration assembly from the interior of an enclosure. The term front will include the surfaces facing the interior of the enclosure while the term back will include the surfaces or regions facing away from the interior of the enclosure.

In one embodiment fenestration assembly 100 is a window such as a casement window. In one embodiment the casement window includes at least one side of the frame and/or sash having a non-linear geometric shape. The non-linear geometric shape may be an arcuate shape or may be a series of linear portions forming a side or plurality of sides of a non rectangular or square shape. However the fenestration assembly may also be a door or other fenestration assembly known in the art.

Fenestration assembly 100 includes a frame assembly 102, a sash assembly 104 and a screen assembly 106. In one embodiment sash assembly 104 moves relative to frame assembly 102 via hardware as disclosed herein.

Figure 3:
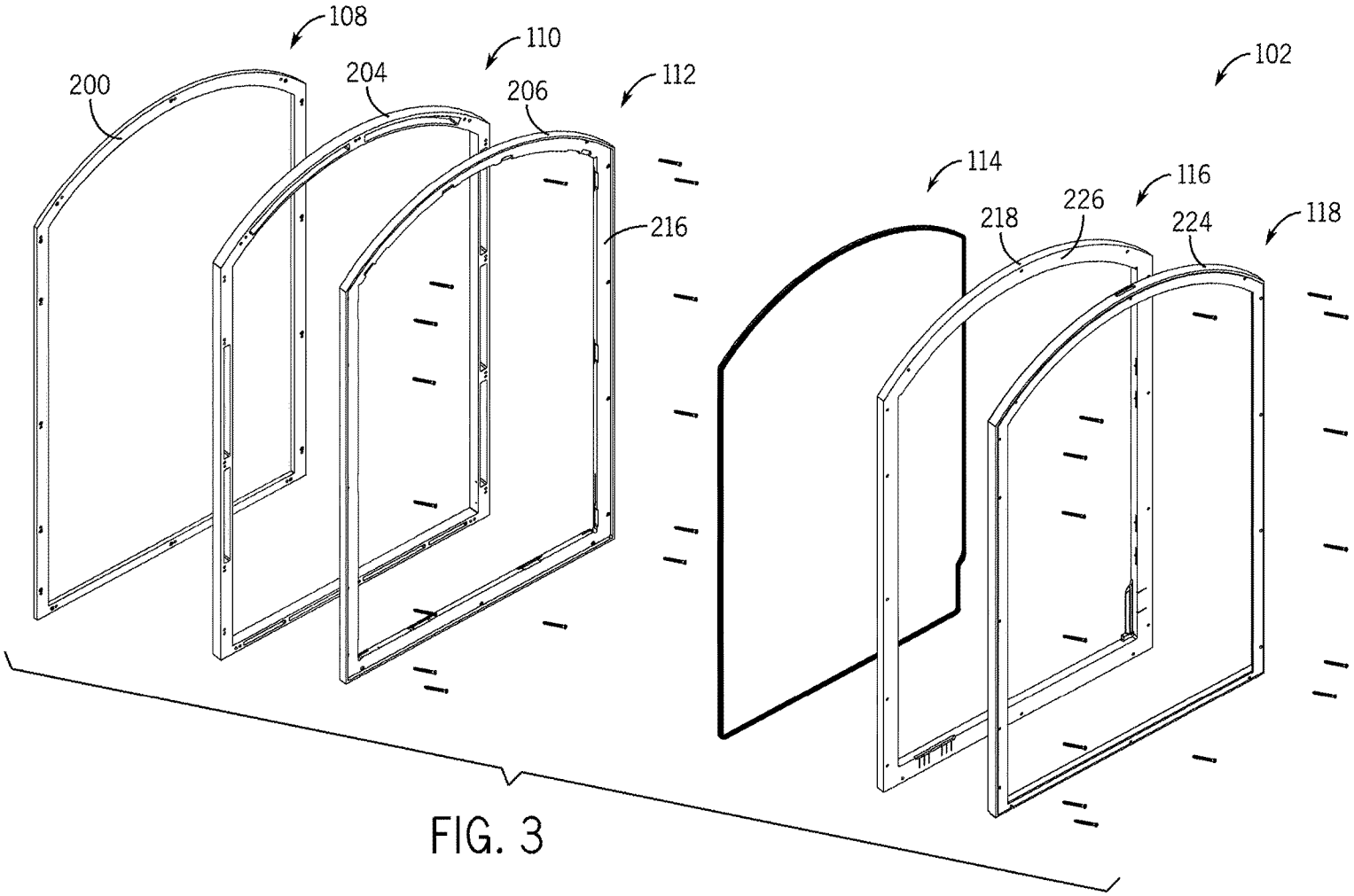
FIG. 3 is an exploded view of the sash assembly of FIG. 1.

Referring to FIG. 3, frame assembly 102 includes a first outer frame member 108 operatively secured to a second outer frame member 110 which in turn is operatively secured to a third outer frame member 112. A weather strip 114 is positioned between the third outer frame member 112 and a fourth inner frame member 116. Weather strip 114 as described further below is secured to fourth inner frame member 116. A fifth inner frame member 118 is operatively secured to the fourth inner frame member 116.

Figure 18A:
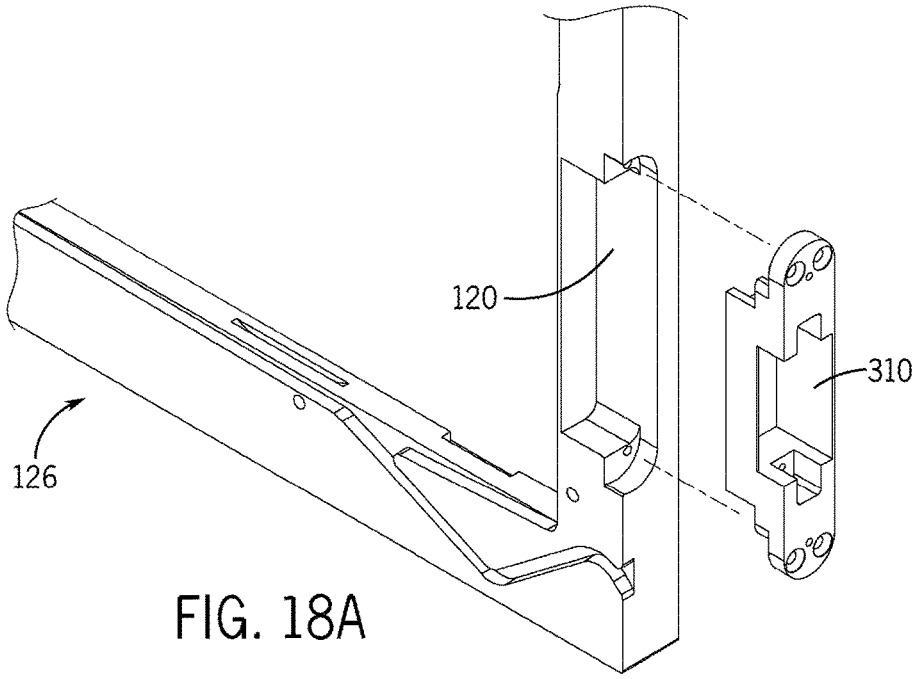
FIG. 18A illustrates a portion of the sash frame and hinge component.
Figure 18B:
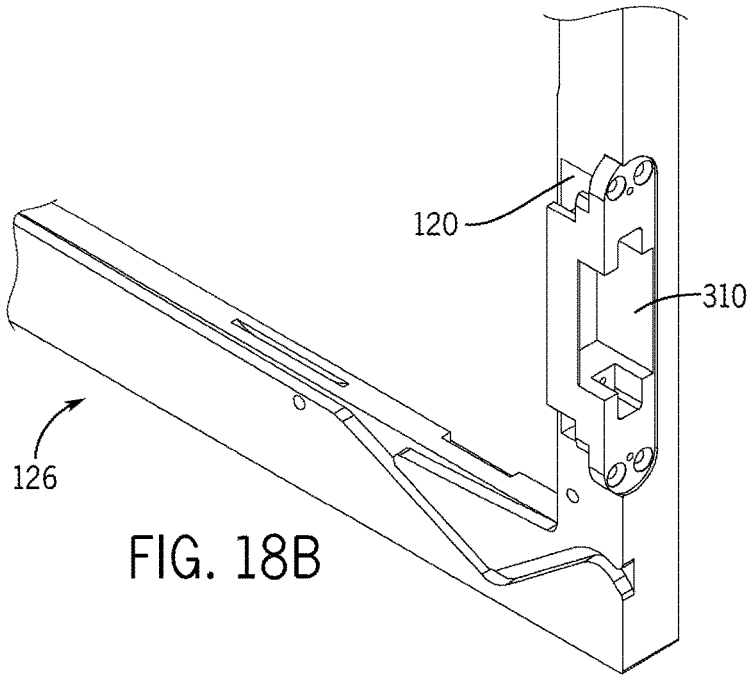
FIG. 18B is a partial isometric view of the sash frame with hinge component installed.

Referring to FIG. 18A second outer frame member 110 includes a first routed region 120 and a second routed region that operatively receives a first sash hinge component of first sash hinge assembly 310 and a second sash hinge component of a second sash hinge assembly respectively.

Figure 4:
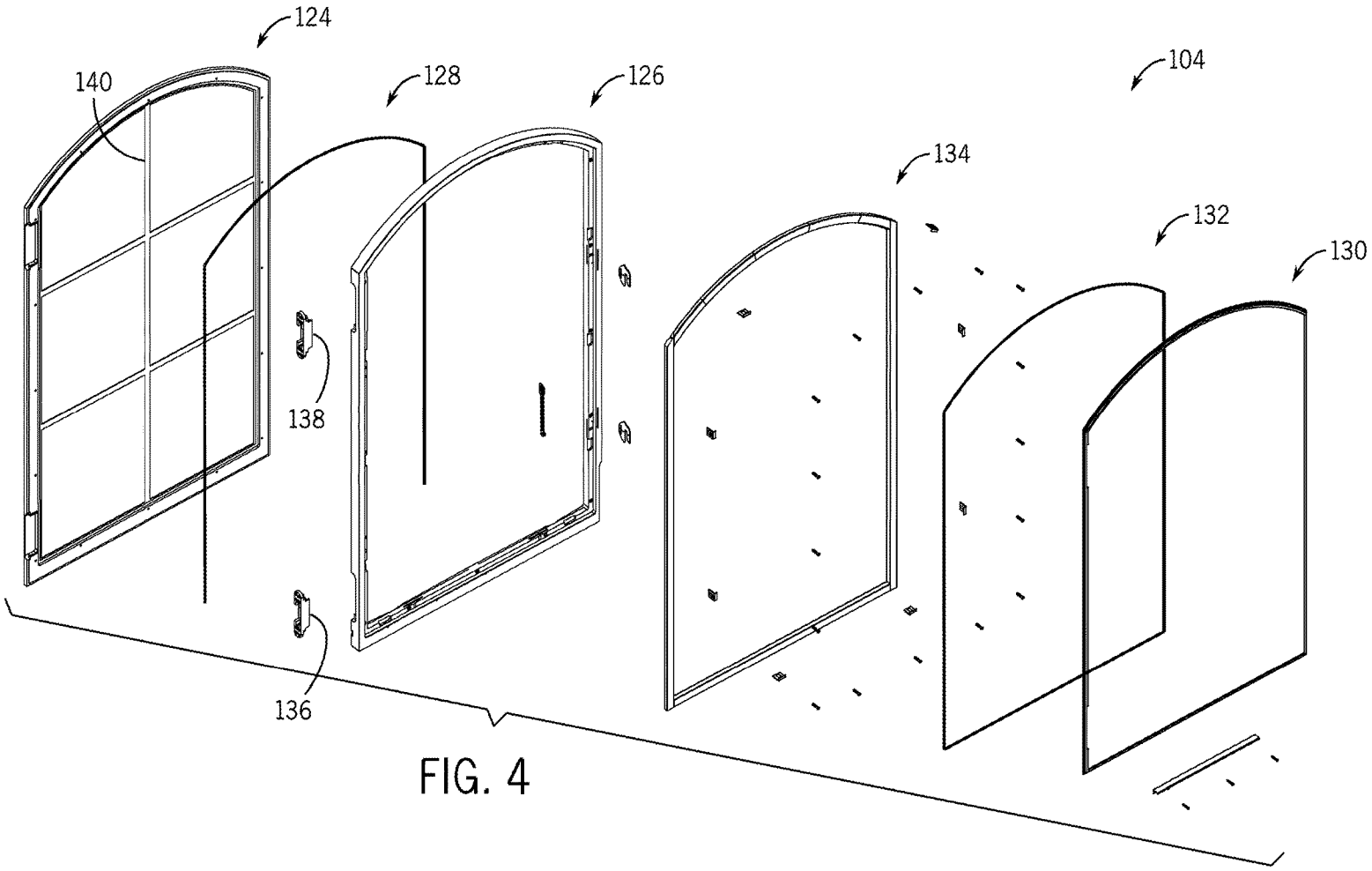
FIG. 4 is an exploded view of the frame assembly of FIG. 1.
Figure 9:
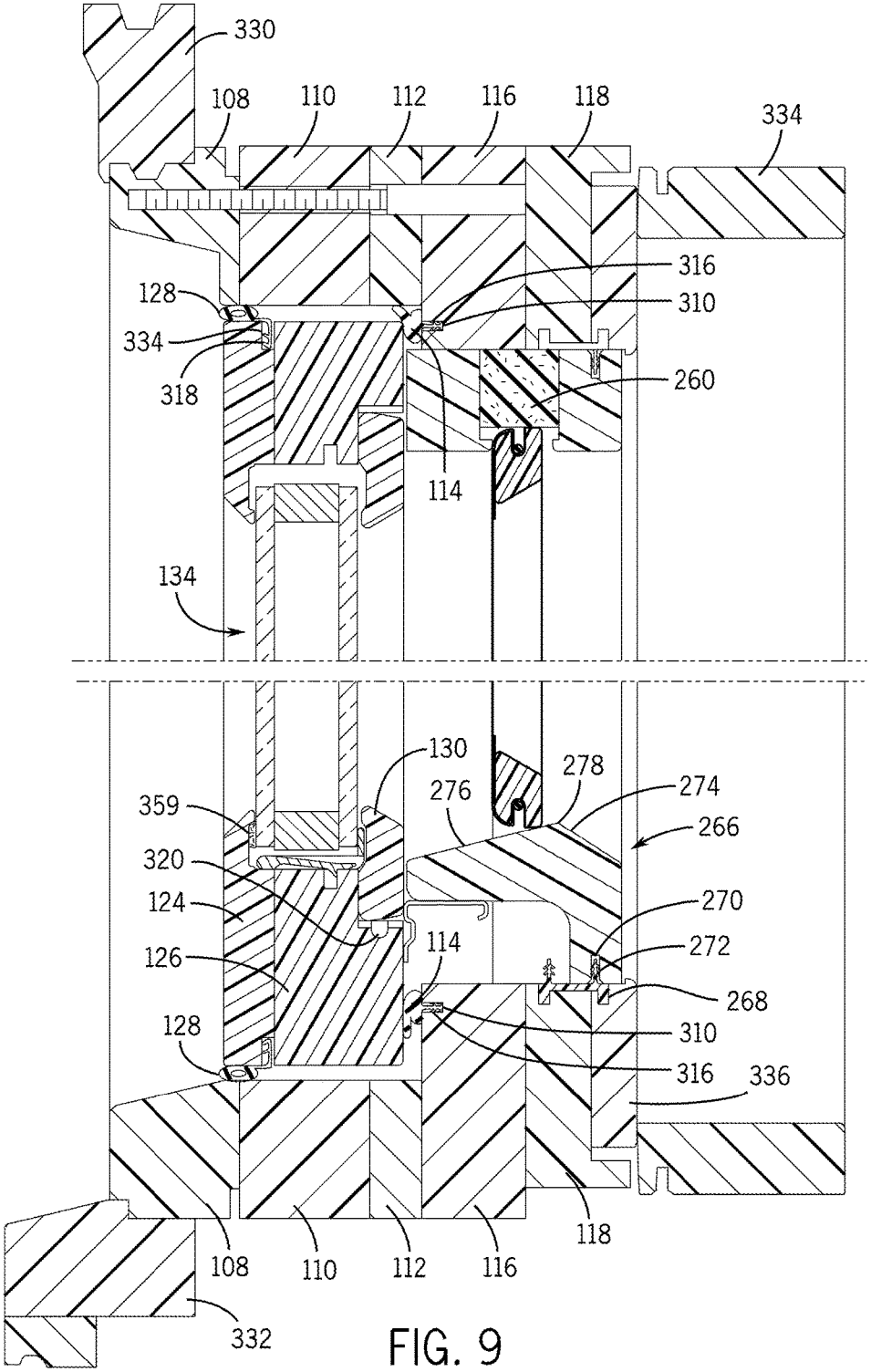
FIG. 9 is a cross sectional view of the fenestration assembly taken generally along line 9-9 of FIG. 1

Referring to FIG. 4, sash assembly 104 includes a first outer sash member 124 operatively secured to a second intermediate sash member 126. In one embodiment a weather strip 128 is positioned between first outer sash member 124 and second intermediate sash member 126. Referring to FIG. 9 weather strip 128 is positioned in a groove 334 formed by a routed region in the inner face of first outer sash member 124 and the adjoining outer face of second intermediate sash member 126. In one embodiment weather strip 128 is continuous about the entire periphery of first outer sash member 124. Weather strip 128 forms a seal between first outers sash member 124 and frame assembly 102 when sash assembly 104 is in the closed position relative to frame assembly 104. In one embodiment weather strip 128 is not positioned about a bottom portion of first outer sash member 124. In one embodiment weather strip 128 is position only about the upper left and right outer periphery of first outer sash member 124.

A third inner sash member 130 is operatively secured to second outer sash member 126. In one embodiment a glazing bead weather strip 132 is proximate third inner sash member 130 and second intermediate sash member 126 and positioned within a groove 320 in second intermediate sash member 126 (See FIG. 9). A glazing assembly 134 is operatively secured intermediate first outer sash member 124, second intermediate sash member 126 and third inner sash member 130. In one embodiment first outer sash member 124 includes a grill 140 extending between a periphery of the first outer sash member 124. In one embodiment first outer sash member 124 and grill 140 is formed from a single material and formed as a single unitary component.

Figure 5:
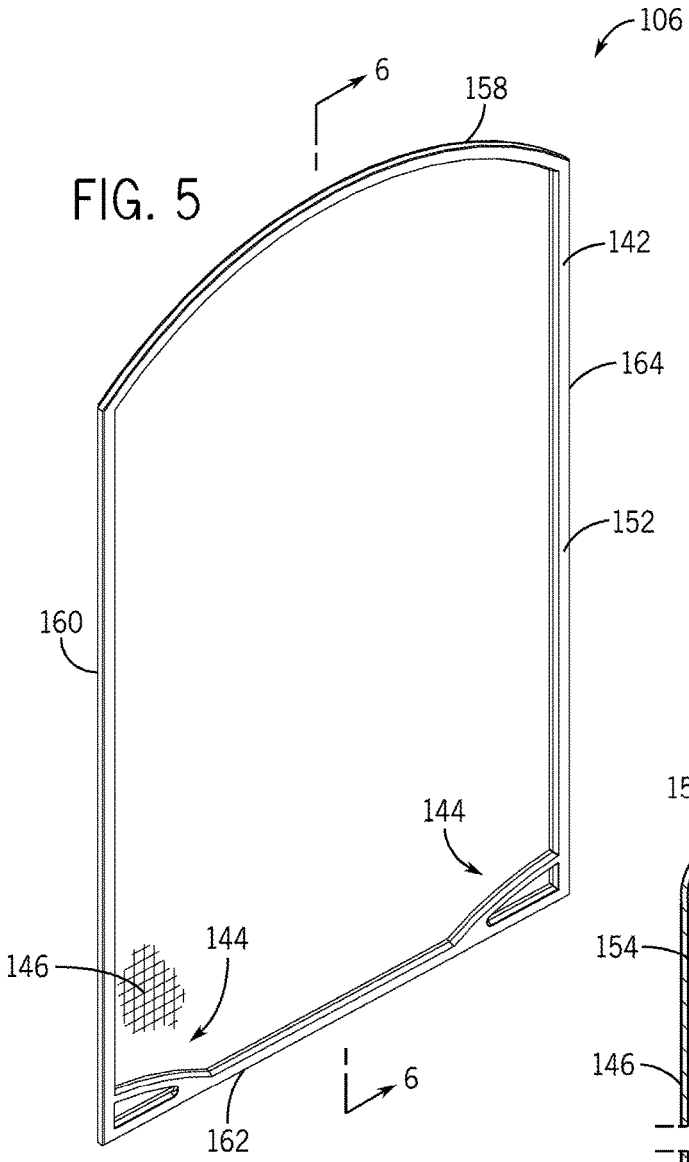
FIG. 5 is an isometric view of the screen of FIG. 1.
Figure 6:
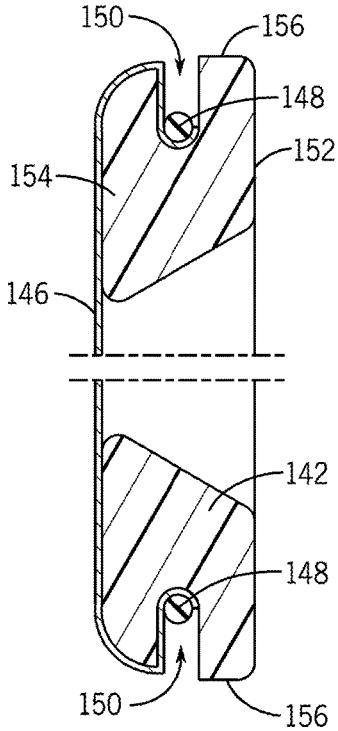
FIG. 6 is a cross-sectional view of the screen taken generally along lines-6-6 of FIG. 1.

Referring to FIG. 2, FIG. 5 and FIG. 6 screen assembly 106 includes a frame member 142 having a pair of handle portions 144 integrally formed with frame member 142. In one embodiment handle portions 144 and frame member 142 is formed as a unitary member from a single sheet of materials as described below. In one embodiment frame member 142 includes a grill that may match the grill 140 of first outer sash member. In one embodiment the screen grill may be formed from a single sheet of material with frame member 142 and in one embodiment the screen grill may be formed of a single sheet of material with no connection to frame member 142. Referring to FIG. 1 screen 106 is located inwardly of sash assembly 104. Screen assembly 106 includes a mesh screen member 146 as is known in the art that is operatively secured to screen frame 142 by a spline 148 that is positioned within a groove 150 that extends completely about the periphery of screen frame 142. Screen frame 142 includes an inner face 152 and an opposing outer face 154. Screen member 146 is adjacent outer face 154 and a terminal end of screen member 146 is positioned within groove 150 captured by spline 148. An edge 156 extends generally perpendicular to inner face 152 and groove 150 extends into screen frame 142 from an exposed portion of frame member 146 in a direction toward generally perpendicular to edge 156 in a direction parallel to face 152. Groove 150 extends completely about the edge 150 of screen frame 142 including an upper arcuate portion 158, a first side 160, a third portion 162 generally opposite arcuate portion 158 and a second side 164 spaced from and generally parallel to first side 160. Of course other geometric configurations are also contemplated. Groove 150 also extends about the corners or transitions between arcuate portion 158, first portion 160, third portion 162 and second portion 164. In one embodiment spline 148 extends continuously within groove 150 about the screen frame 142 with only two terminal ends that meet or are proximate one another within groove 150. In one embodiment arcuate portion 158 is an upper portion and third portion 160 is a bottom portion. Groove 150 in one embodiment is on the exterior edge or outer periphery of the screen frame such that it is not visible by a viewer when the screen is in positioned within the frame assembly as discussed herein.

Figure 21:
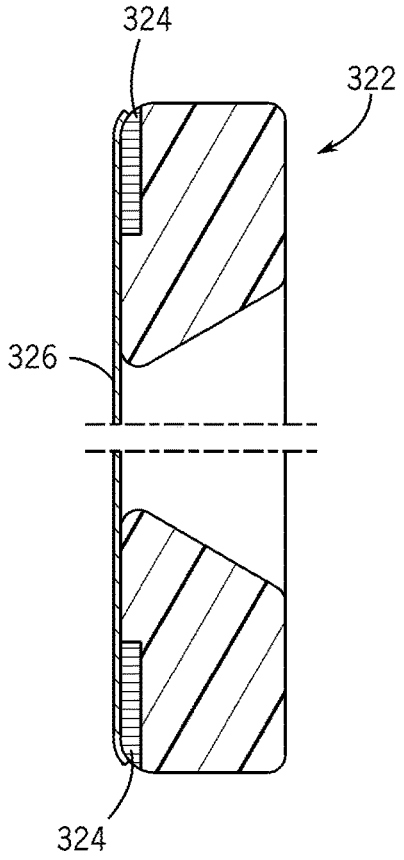
FIG. 21 is one embodiment of a screen assembly.

Referring to FIG. 21 in one embodiment a screen assembly 322 includes a hook type material 324 that is secured to an outer face of screen assembly 322 in a notch located adjacent to the periphery of screen assembly 322. Screen mesh 326 is operatively secured to the frame of screen assembly 322 by the openings in screen mesh 326 being engaged by the hook material 324. Hook material 324 in one embodiment is similar to the hook material in the Dual Lock material known in the art or in the hook material of the hook and loop material sold under the tradename Velcro. Hook material 324 includes a plurality of hook type members extending in the outward direction that are small enough to fit between the openings in screen mesh material 326 to operatively secure screen mesh material 326 to frame assembly 322. In one embodiment the hook type members in the hook material 324 are strong enough to maintain screen mesh material 326 with tension about frame assembly but allow for the removal of screen mesh material 326 for replacement and/or repair. FIG. 21 is a cross section of screen assembly 322 that is similar to cross section 6-6 of FIG. 5.

Figure 7A:
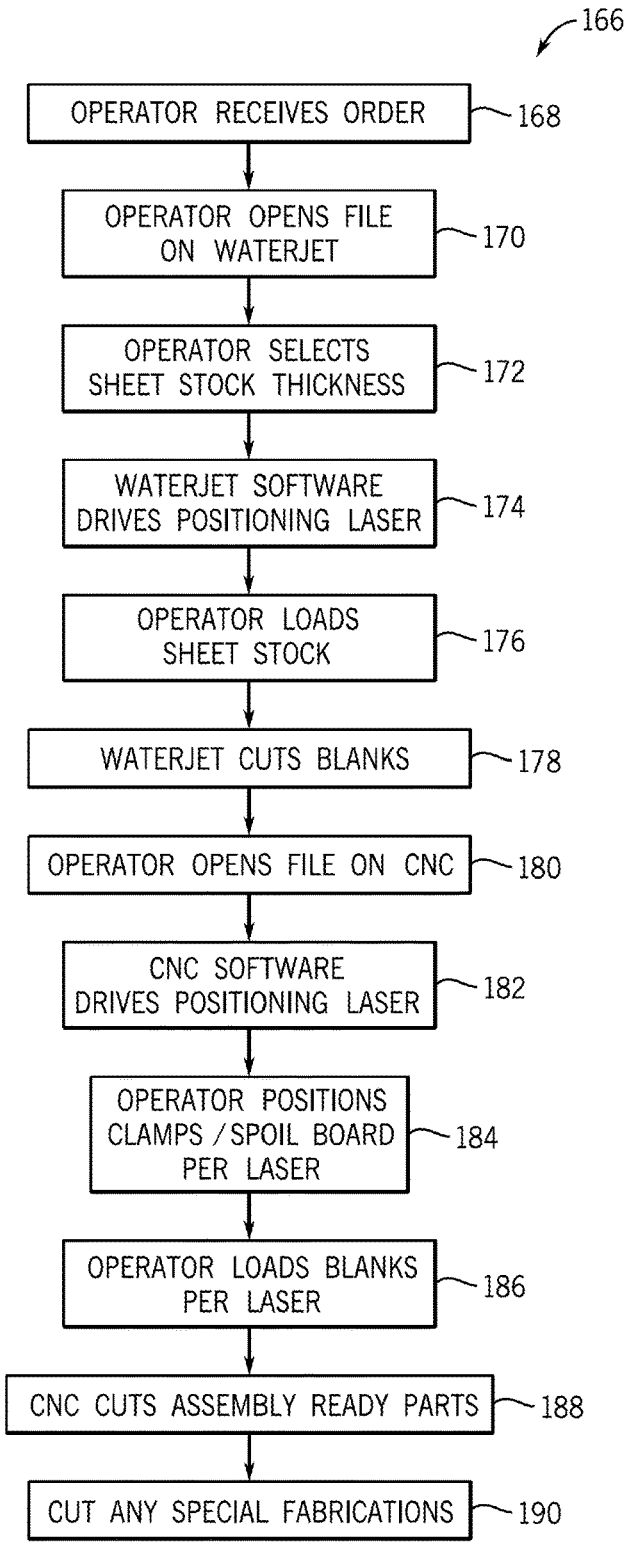
FIG. 7A is an illustration of a method of fabricating components of the fenestration assembly from creating a component from scrap materials.

Referring to FIG. 7A an example method 166 of manufacturing is utilized to fabricate the elements of frame assembly 102 and sash assembly 104. As shown by block 168 an operator receives an order for a particular fenestration assembly 100 including the frame and sash dimensions having particular shapes. As shown by block 170, the operator opens a digital file on a computer aided cutting apparatus such as a water jet. The operator then selects sheet stock as illustrated in block 172 having a given thickness for a particular component of the frame or sash and positions the sheet stock on a water jet cutting apparatus as is known in the art. In one embodiment sheet stock may be a wood, wood composite material or other material that includes a phenolic material. In one embodiment a phenolic material is in the form of a sheet having a height, width and thickness dimension that are a great as the height, width and thickness of the finished frame component.

Phenolic material includes a composite resin material made from a combination of phenol and aldehyde formed into a rigid planar material. In one embodiment the sheet material used to fabricate the unitary frame and sash members are formed from a medium density overlay panel (MDO) that is a paintable surface made of plywood with a weather-resistant resin overlay bonded to the wood by heat and pressure. The term sheet material as used herein defines a sheet of material with a length and width dimensions that is much greater than the thickness. In one embodiment the length and width dimension are at least 10 times the thickness of the sheet material.

Referring to block 174 waterjet software is used to drive a positioning laser and in block 176 the operator utilizing the positioning laser loads the stock sheet material into the numeric controlled waterjet cutting apparatus. Once the sheet material is positioned the water jet cuts a blank or blanks from the sheet material as illustrated in block 178.

Once the blanks are cut by a water jet or other cutting equipment known in the art, the cut blanks are then further processed with a cutter and/or router to fully fabricate particular members of the frame and sash assembly. Referring to block 180 the operator opens the digital CNC (computer numerical control) software for routing and/or cutting the blanks. The blank is then positioned on the CNC routing and/or cutting equipment aided by use of a positioning laser as shown in blocks 182-186. In blocks 184-186 the operator loads then secures the blank in the routing and/or cutting equipment. In blocks 188 and 190 the CNC equipment then routes and/or cuts the blank to form the final member for the frame assembly or sash assembly. For example and referring to FIG. 8C second intermediate sash member 126 includes a routed region 120 to receive a hinge that operatively and movable connects sash assembly 104 to frame assembly 102.

In one embodiment the ready to assembly component that is formed is a unitary component having features in three dimensions. The process 166 is repeated to form all of the parts required for the assembly of the frame assembly, sash assembly and screen assembly that will form the fenestration assembly.

In one embodiment process 166 is repeated to form five separate frame components as noted above. In one embodiment first outer frame member 108 is formed from a 1¼ inch phenolic sheet material; second outer frame member 110 is formed from a 1¼ inch phenolic sheet material; third outer frame member 112 is formed from a ½ inch phenolic sheet material; fourth inner frame member 116 is formed from a 1 inch MDO sheet material and fifth inner frame member 118 is formed from a 1 inch MDO (Medium Density Overlay such as engineered plywood) sheet material. As will be discussed below the frame components are secured together with fasteners such as confirmat screws. In addition to the five frame members noted above it is also possible to fabricate other frame members such as a vertical jamb cover, a jamb header, a sill cover, a jamb extender, an interior mull cover, a screen lineal, a screen handle and other components.

Figure 7B:
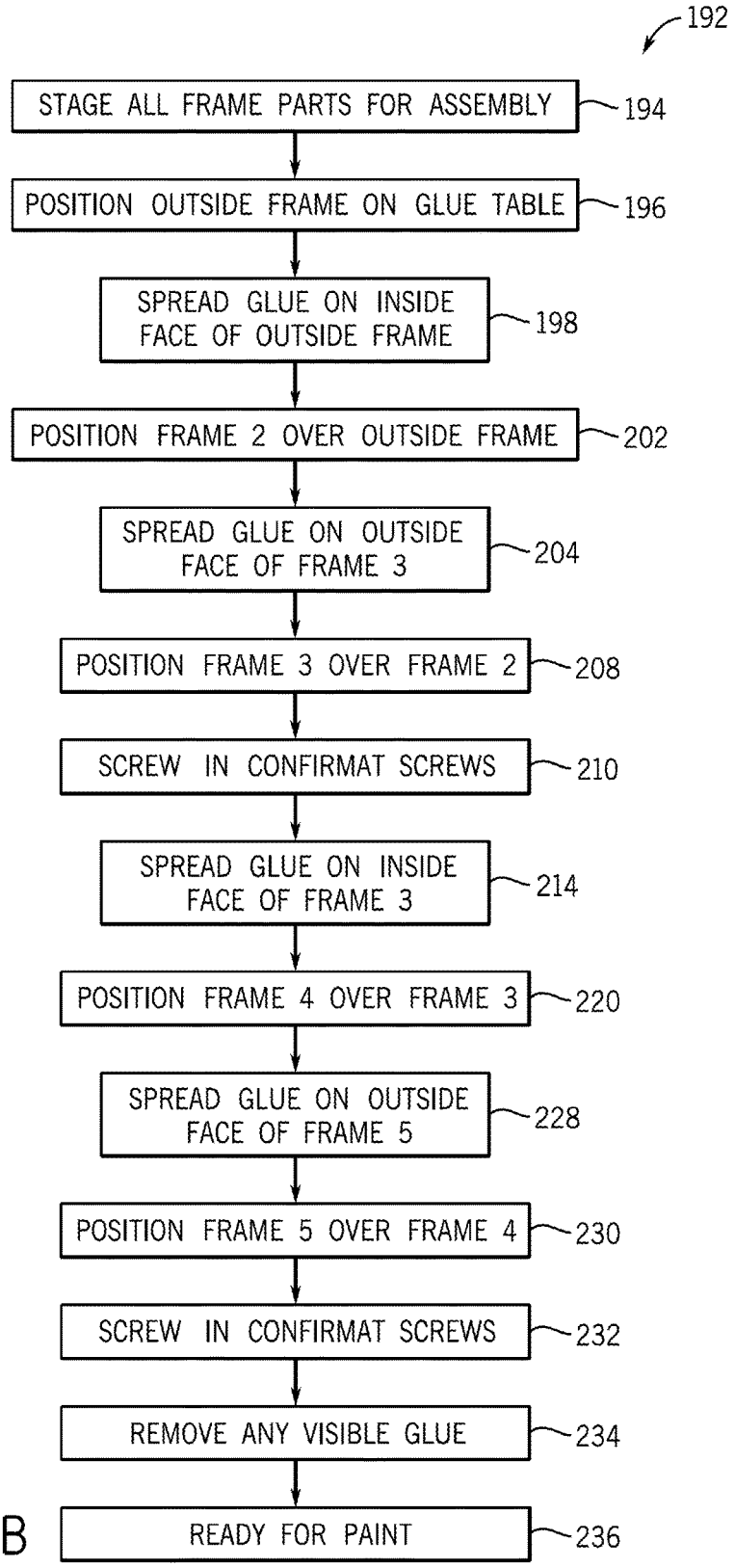
FIG. 7B is an illustration of a method of assembling the frame and sash assemblies.

Referring to FIG. 7B a process 192 illustrates a procedure for forming the frame assembly 102 from the various frame components formed in process 166. Referring to block 194 an operator stages all of the frame components for assembly. In a block 196 and 198 the operator positions the first outer frame member 108 and applies an adhesive glue to an inside face 200 of the first outer frame member 108. In block 202 the operator then positions the second outer frame member 110 over the first outer frame member 108 such that the outside face 204 of the second outer frame member 110 is adjacent to the inner face 200 of the first outer frame member 108.

In block 204 the operator spreads an adhesive glue on the outside face 206 of third outer frame member 112 and positions the outside face 206 of the third outer frame member 112 over the second outer frame member 110 as illustrated in block 208. The operator in block 210 then fastens with screws such as confirmat screws 212 third outer frame member 112 to the second outer member 110.

In block 214 an operator applies an adhesive glue to an inside face 216 of third outer frame member 112 and positions an outside face 218 of the fourth inside frame member 116 over the inside face 216 of third outer frame member 112 is illustrated in block 220. Referring to block 228 and block 230 an adhesive is applied to an outside face 224 of fifth inside frame member 118 and positioned over the inside face 226 of fourth inside frame member 116. Fourth inside frame member 116 and fifth inside frame member 118 are operatively further connected with a fastener such as a confirmat screw as illustrated in block 232. Referring to block 234 and block 236 any extra adhesive glue is removed from the frame assembly and then and ready for painting.

Figure 8A:
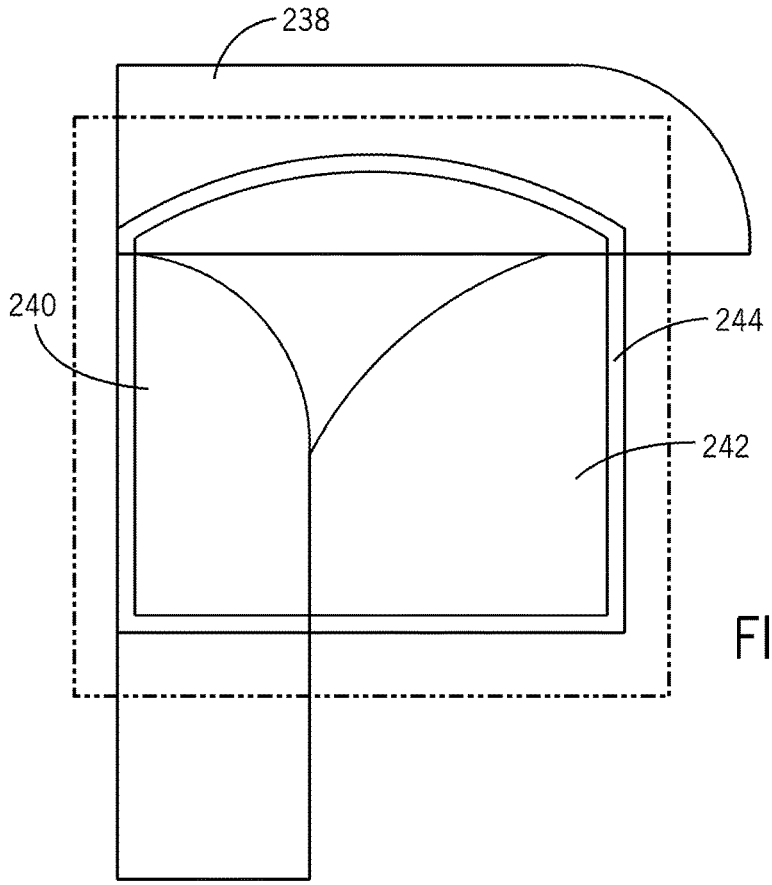
FIG. 8A is an illustration of a blank being prepared from three scrap pieces of material.
Figure 8B:
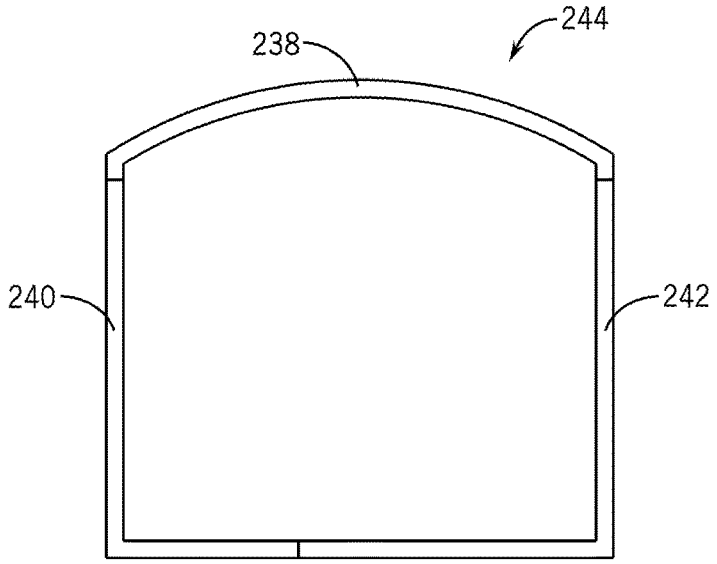
FIG. 8B is the resultant blank formed from the scraps of FIG. 8A.

Referring to FIG. 8A and FIG. 8B in one embodiment scrap materials 238, 240 and 242 that result from process 166 may be glued together to form a material sheet from which a new blank 244 may be formed as illustrated in FIG. 8B. Referring to FIG. 8B blank 242 which may be formed in process 166 into one of the members forming the frame assembly 102, sash assembly 104 and screen assembly 106 include portions from scrap materials 238, 240 and 242. In this manner member scrap from process 166 may be utilized to form additional members. In this secondary embodiment member 244 is formed from more than one continuous unitary material. Referring to FIG. 8B member 244 is formed from three different scrap portions 238, 240 and 242. Referring to FIG. 8B the connecting lines between portions 238, 240 and 242 are spaced from each corner. Each corner being created from only one of portions 238, 240 and 242. Member 244 including a first corner and a second corner defined solely by first portion 238, a third corner defined solely by second portion 240 and a fourth corner defined solely by portion 242.

Figure 8C:
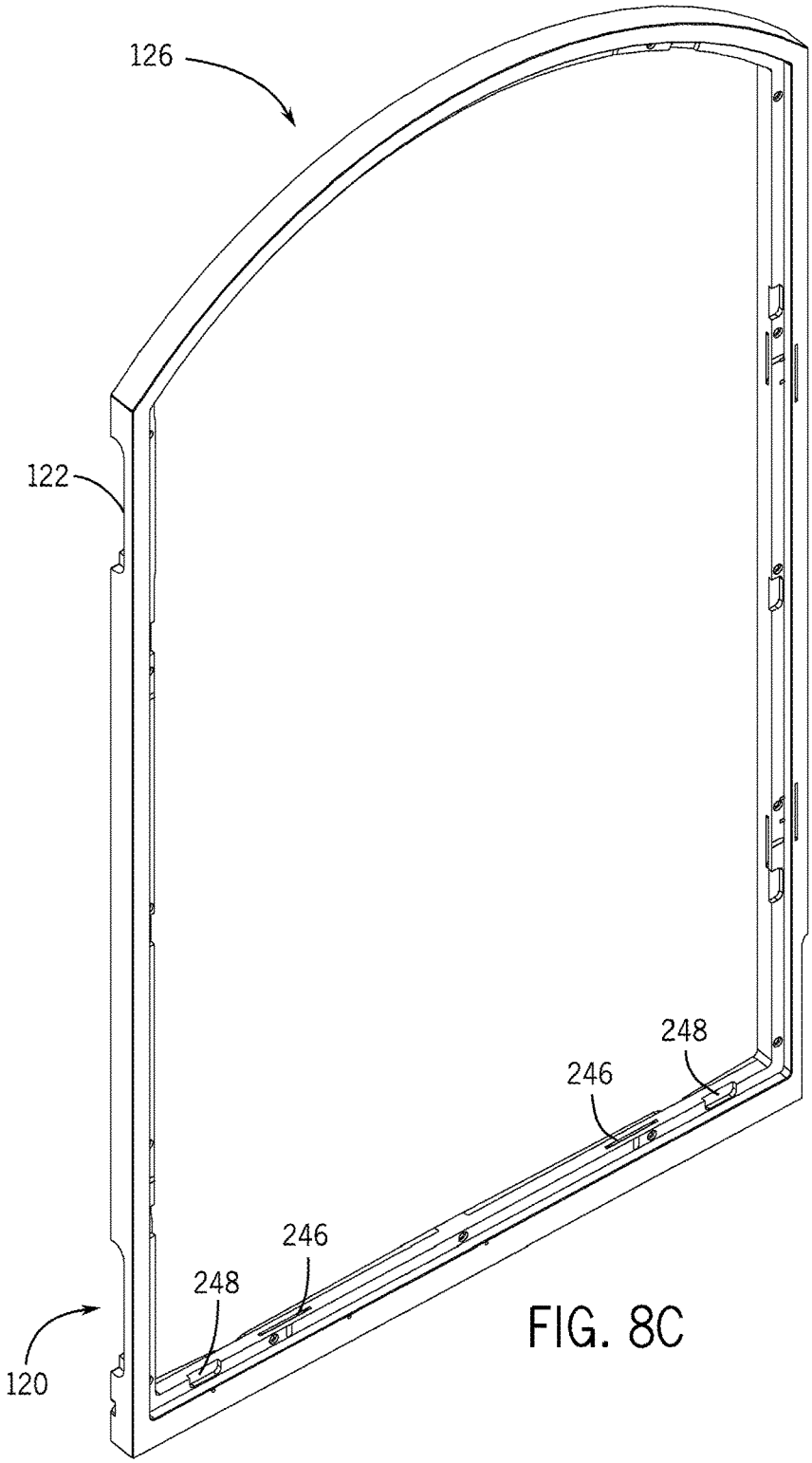
FIG. 8C is an exemplary component of the sash assembly from process 7A.

Referring to FIG. 8C a completed second intermediate sash member 126 is formed with routed hinge regions 120 and 122; slits 246 to receive a tab for a glazing clip as described in further detail herein below; recess portions 248 for providing a fastener such as a hook and loop material reclosable fastener like Dual Lock™ to operatively secure third inner sash member 130 to second intermediate sash member 126; and other feature for securing lock hardware and other operational hardware for opening and closing sash assembly 104 relative to frame assembly 102. The hardware includes an operator for opening and closing sash assembly 104 relative to frame assembly 102; at least one lock handle assembly including a lock handle and a lock bar assembly. In one embodiment third inner sash member 130 includes a glazing bead portion, wherein third inner sash member 130 is secured to second intermediate sash member 126 solely with a hook and loop material. In this third inner sash member 130 may be removably secured to second intermediate sash member 126 without the use of tools and allowing for easy access to glazing assembly 134. In one embodiment third inner sash member 130 includes a glazing bead portion, wherein third inner sash member 130 is secured to second intermediate sash member 126 solely with a magnet. In one embodiment third inner sash member 130 includes a glazing bead portion, wherein third inner sash member 130 is secured to second intermediate sash member 126 solely with one or a combination of connectors that do not require tools to remove the third inner sash member from the second intermediate sash member such as a hook and loop material and a magnet.

Figure 10A:
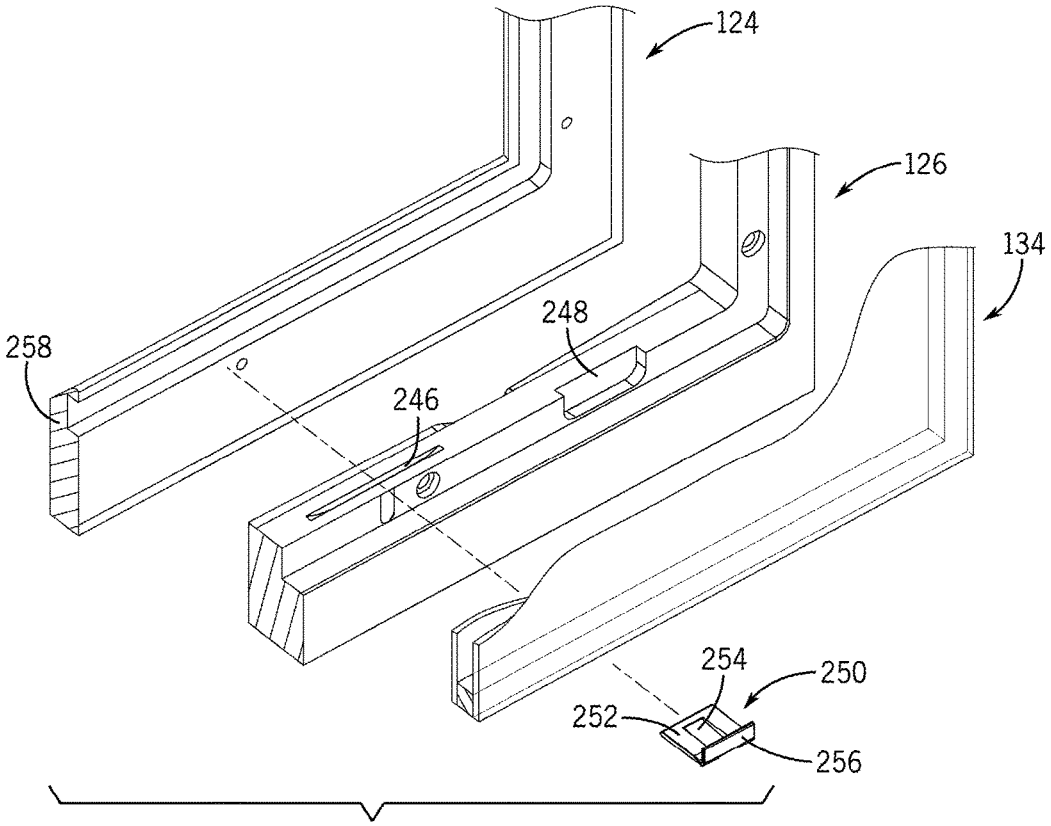
FIG. 10A is a partial exploded view of a portion of the sash assembly and glazing clip.
Figure 10B:
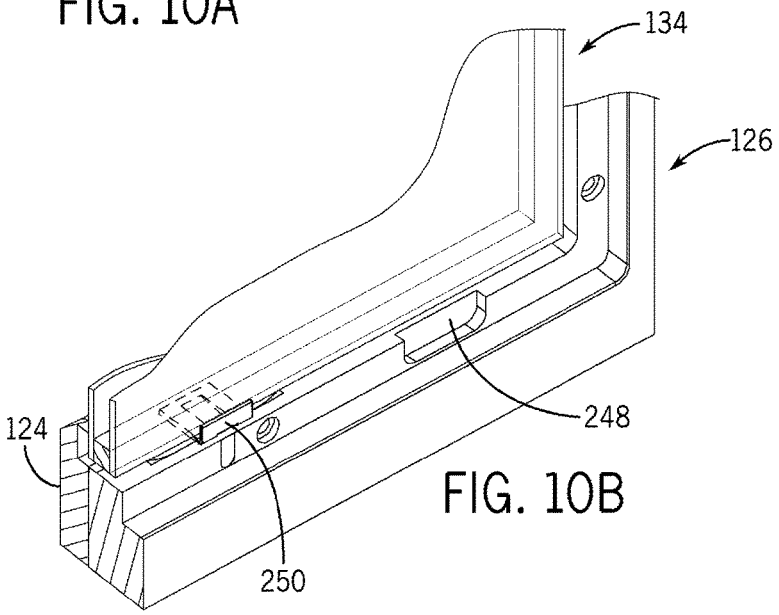
FIG. 10B is a partial isometric view of a glazing being secured to two components of the sash.
Figure 24:
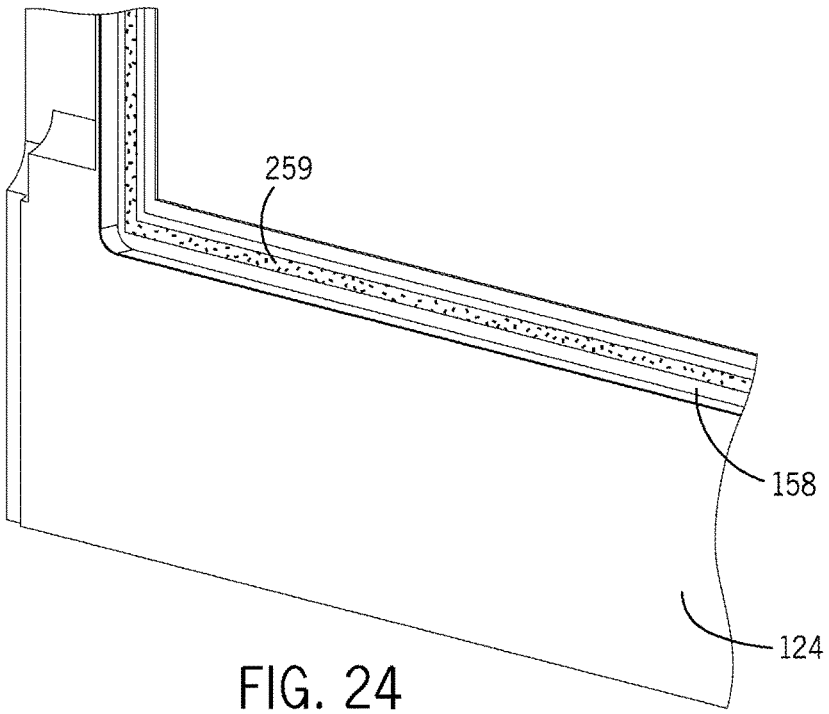
FIG. 24 is a partial isometric view of a continuous glazing lip.

Referring to FIG. 9, FIG. 10A and FIG. 10B a glazing clip 250 includes a base portion 252, a tab 254 secured to base portion 252 and extending in a first direction away from a plane defined by base portion 252. Glazing clip 250 includes a raised wall region 256 extending away from an edge of base portion 252 in a perpendicular direction from the plane defined by base portion 252 in a direction opposite the first direction that tab 254 extends from base portion 252. A terminal end portion of tab 252 is positioned within slot 246 of second intermediate sash member 126 such that raised wall portion 256 contacts a lower edge of glazing assembly 134. Since second intermediate sash member 126 has been fastened to first outer sash member 124 glazing clip 250 acts to hold glazing assembly 134 against a glazing lip region 258 while a seal 259 such a silicone seal cures between glazing assembly 134 and glazing lip region 258. A number of glazing clips 250 are similarly positioned about glazing assembly 134 in respective slots 246 to operatively secure glazing assembly 134 to sash members 124 and 126. In this manner glazing assembly 134 and sash members 126, 128 can be moved from a generally horizontal orientation to a vertical orientation. The horizontal orientation is the defined as the orientation in which the glazing glass members define a plane perpendicular to the direction of gravity and the vertical orientation is perpendicular to the horizontal orientation. Stated another way the vertical orientation is the general orientation of a window would be typically positioned in a side of a structure that a person would look through while standing in the structure and not having to look upward as in a sky light orientation. Referring to FIG. 24 continuous glazing seal 259 extends about a transition or corner of glazing region 258 of first outer sash member 124. In this manner there are not disruptions or gaps in the corners since the glazing region provides a continuous flat surface. Three continuous glazing lip provides an optimum seal to glass.

Figure 13A:
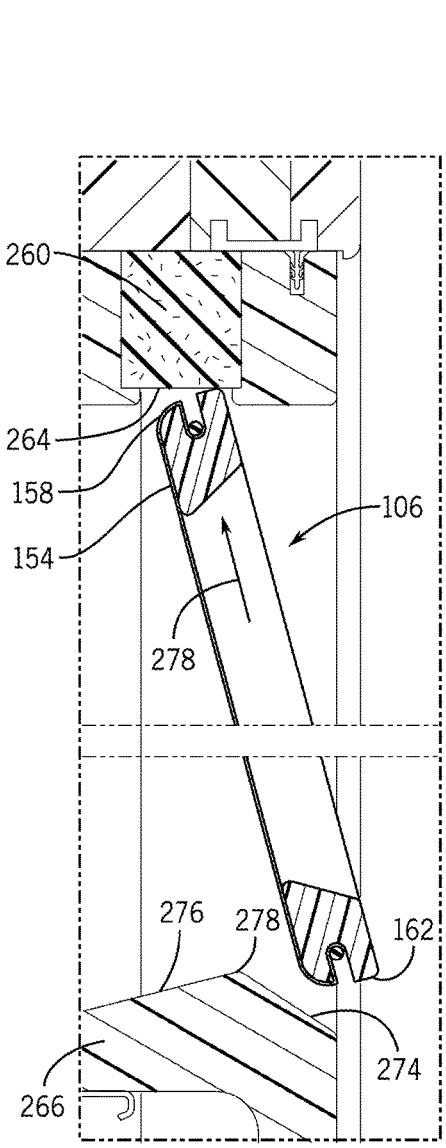
FIG. 13A is a partial isometric view of the screen being inserted into the frame header in a first position.
Figure 13B:
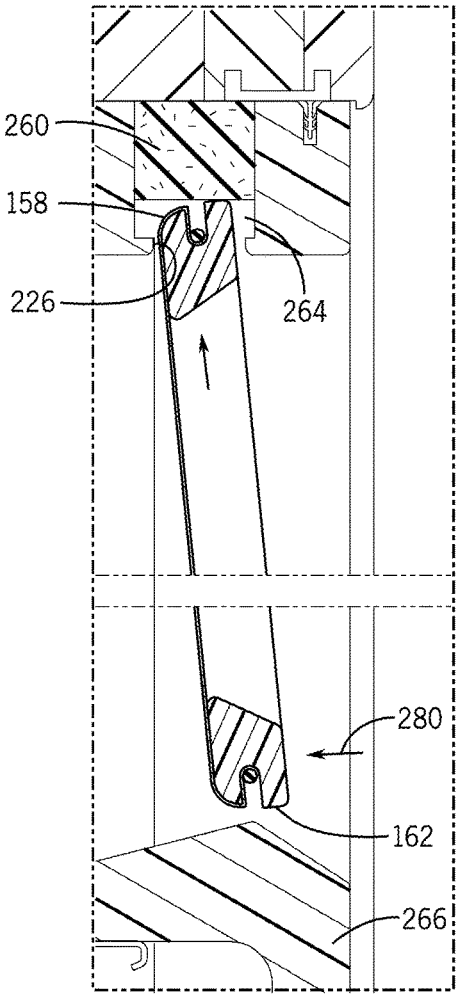
FIG. 13B is a partial isometric view of the screen being inserted into the frame header in a second position.
Figure 14A:
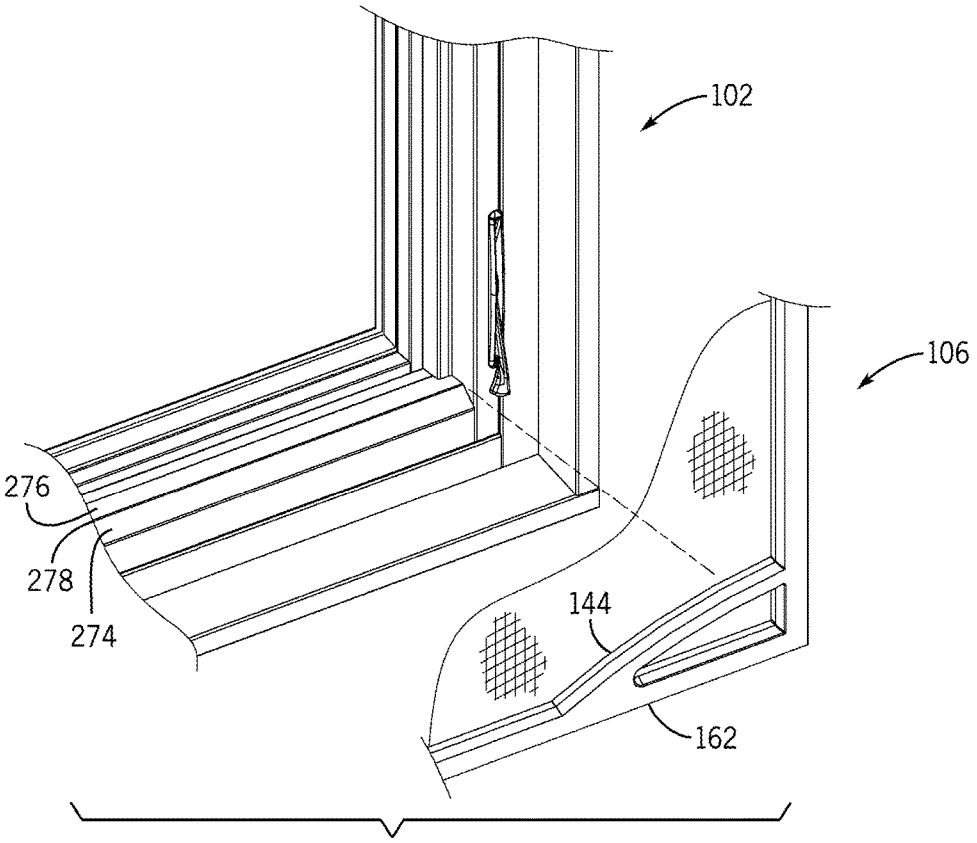
FIG. 14A is a cross sectional view of the screen prior to being inserted into the frame.
Figure 14B:
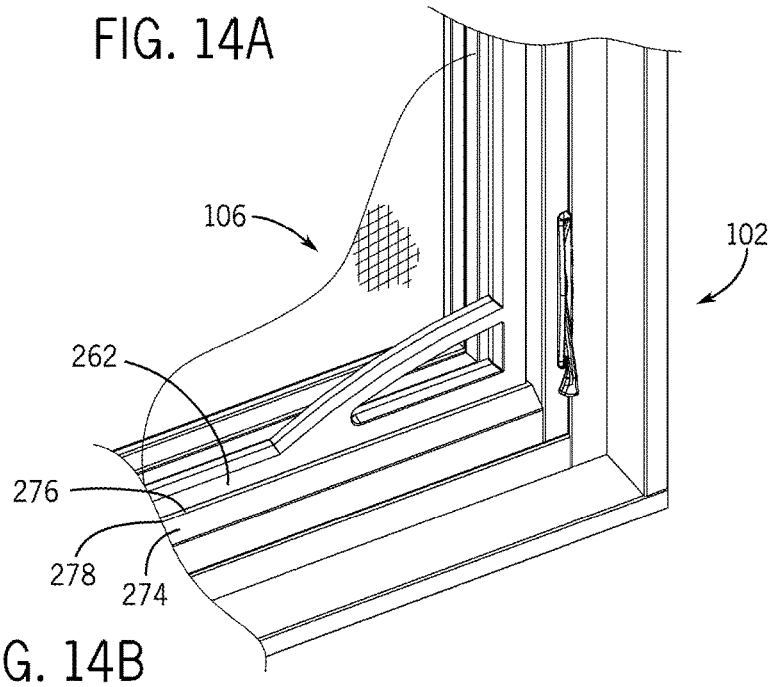
FIG. 14B is a partial isometric view of the screen inserted within the frame.

Referring to FIG. 9, FIG. 13A and FIG. 13B screen assembly 106 is positioned within frame assembly 104 by use of at least one biasing member 260 positioned within a header region 262 of frame assembly 104. Biasing member 260 in one embodiment is a foam cylindrical member that is positioned within a groove 264 of header region 262. Arcuate portion 158 of screen assembly 106 is positioned within groove 264 by an operator. As arcuate portion 158 is received within groove 264 a region of arcuate portion 158 contacts the biasing member or members 260 and depresses the biasing member 158 until bottom portion 162 clears an inner sill member 266 that is operatively connected to the frame assembly. In one embodiment inner sill member 266 is connected to frame assembly 104 with a fastener 268 having at least one barbed tab 272 fitting within a groove 270 of inner sill member 266.

Referring to FIG. 13A Inner sill member 266 includes a first sloped region 274 having an incline terminating in an apex 278 and a second sloped region 276 extending from apex 278 in a direction away from first sloped region 274 and in a generally opposite direction. Referring to FIGS. 13A and 13B as user positions screen assembly 106 within groove 264 such that arcuate portion 158 contacts biasing member 260 and continues to move screen assembly 106 in a direction 278 until portion 162 clears apex 278 of inner sill member 266. Biasing member 260 is then compressed and provides a force on screen assembly toward inner sill member 266 and forces portion 162 of screen assembly 106 to contact second sloped region 276 of inner sill member 266. The outer face 154 of screen assembly 106 is in contact with the inner face 226 of fourth inner frame member 116. To remove screen assembly from frame assembly 104 a user utilizing handles 144 urges frame assembly into groove 264 depressing biasing member 264 and pulling portion 162 up and over apex 278 of inner sill member 266 and then pulling portion 162 in a direction generally opposite to vectors 278 and 280. In one embodiment biasing member 260 is a foam spring to provide tension/pressure on the top of the screen frame to hold the screen in place in the frame assembly.

Figure 11:
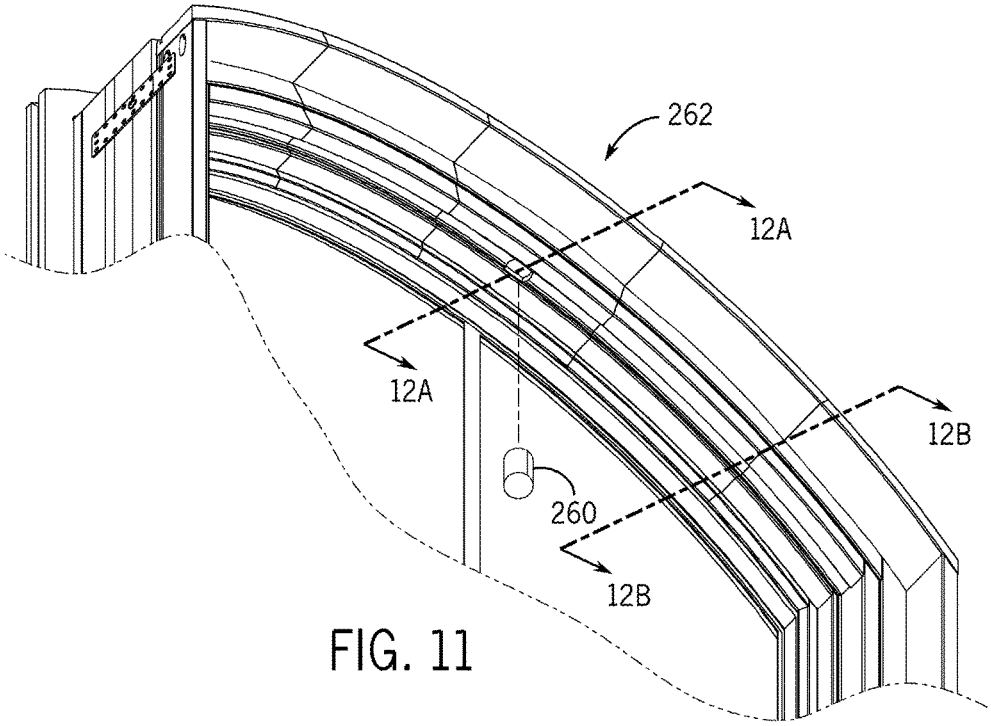
FIG. 11 is a partial isometric view of the arcuate portion of the frame.
Figure 12A:
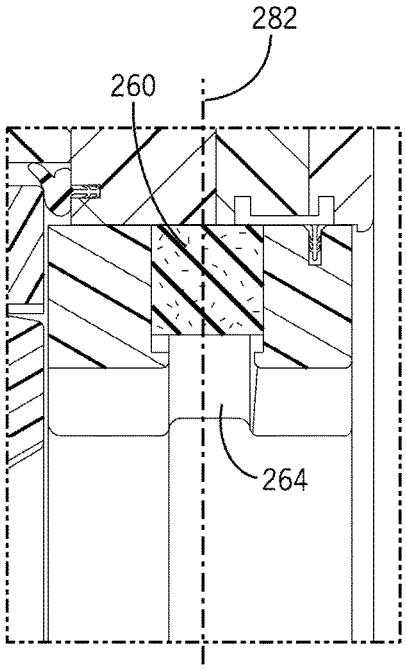
FIG. 12 A is a cross sectional view taken generally along line 12A-12A of FIG. 11.
FIG. 12B is a cross sectional view taken generally along line 12B-12B of FIG. 11.
Figure 12B:
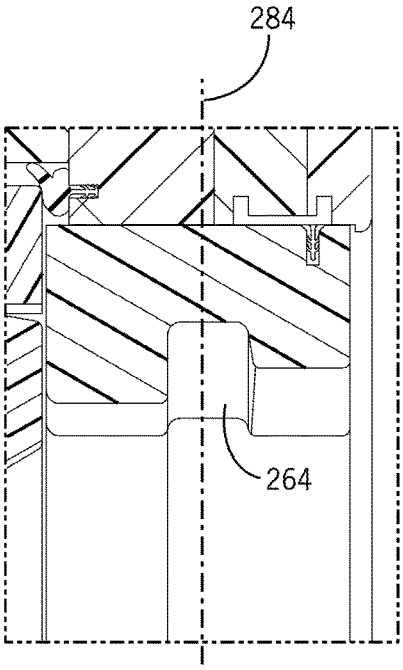

Referring to FIG. 11, FIG. 12A and FIG. 12B groove 264 is deeper near the center of the arcuate portion of frame assembly 104 than the sides of arcuate portion of frame assembly 104. Stated another way the depth of groove 264 at section 12A-12A of frame assembly 104 has a greater longitudinal depth along axis 282 than along axis 284 at section 12B-12B. This differential in depth provides for an easier insertion and removal of arcuate portion 158 of screen assembly 106 within arcuate header of frame assembly 104.

Figure 15A:
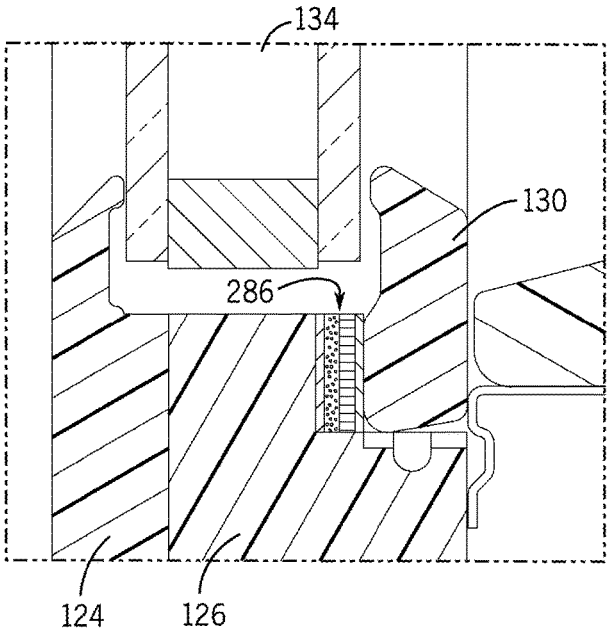
FIG. 15A is a cross-sectional view of the sash assembly with the glazing bead secured to the sash frame member with a fastener.
Figure 15B:
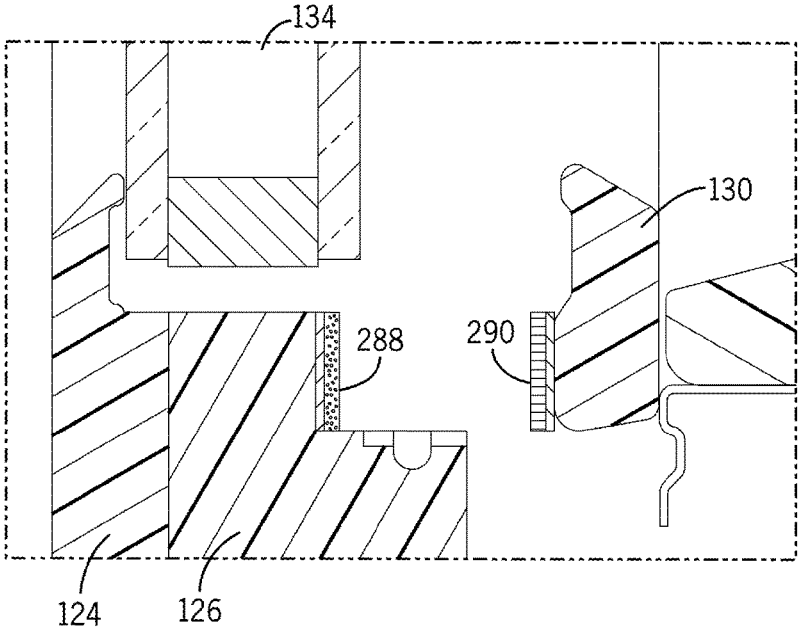
FIG. 15B is a partial exploded cross-sectional view glazing bead prior to attachment to the sash frame member.

Referring to FIG. 15A and FIG. 15B third inner sash member 130 that includes the glazing bead is operatively secured to second intermediate sash member 126 with a reclosable fastener 286 Dual Lock™ fastener. Referring to FIG. 10B and FIG. 15B a first portion of the reclosable fastener 288 is operatively secured within a routed recess region 246 of second intermediate sash frame 126 and a second portion 290 is operatively secured to a corresponding portion of third inner sash member 130. A user then presses third inner sash member 130 toward second intermediate sash member 126 until the first portion 288 and the second portion 290 of the reclosable fastener engage and secure third inner sash member to second intermediate sash member 126. Other releasable and reusable fasteners that also do not require the use of a separate tool to operate are also contemplated for example magnets or other hook and loop style materials.

Figure 16:
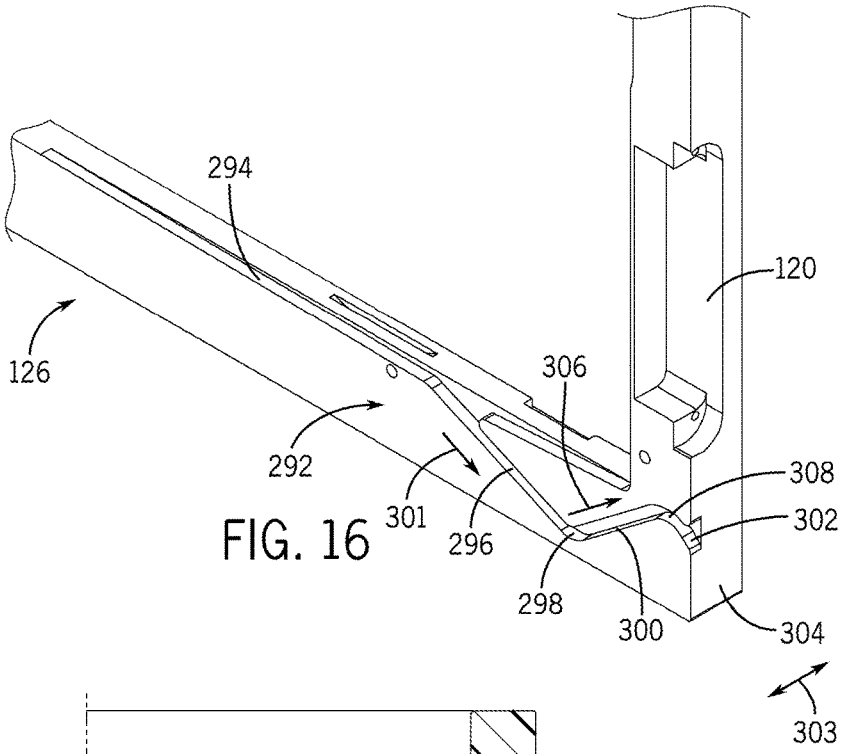
FIG. 16 is a partial isometric view of an integral weep path.

Referring to FIG. 16 a weep path 292 is illustrated for a path for liquid that may enter the sash assembly to be vacated from the fenestration assembly. A path 292 is created by a routed path extending into second intermediate sash member 126. Path 292 includes a first downwardly extending portion 296 that extends from an upper surface 294 that defines a generally horizontal plane when the fenestration assembly is in an in use position in an vertical wall of a structure. Path 292 includes a bottom portion 298 that is a given vertical distance from upper surface 294 in a direction defined by vector 301 which is the same direction as gravity when the fenestration assembly in an in use position in a vertical wall of a structure. Path 294 includes a portion 300 which extends from bottom portion 298 in a vector direction 306 generally opposite and perpendicular to the slope defined by the slope defined by path portion 296. Path portion 300 is in fluid communication with a portion 302 that has a vertical vector distance from region 294 that is less than the given vertical vector distance of bottom portion 298 from region 294. Path portion 302 has an exit to surface 304 of second intermediate member 126. In operation water that may enter path 292 from region 294 will flow downwardly along path portion 296 and only exit path 292 at surface 304 when the height of water in path 296 from bottom portion 298 along vector 306 is greater than the distance along vector 306 between exit apex portion 308 and bottom portion 298. A certain amount of water will remain within path 292.

Weep path 292 is completely routed in second intermediate sash member 126 and therefore does not requires any further drilling of apertures after the formation of intermediate sash member 126 by process 166. Weep path 292 is closed off in the direction 303 by the inner face of first outer sash member 124.

Figure 17:
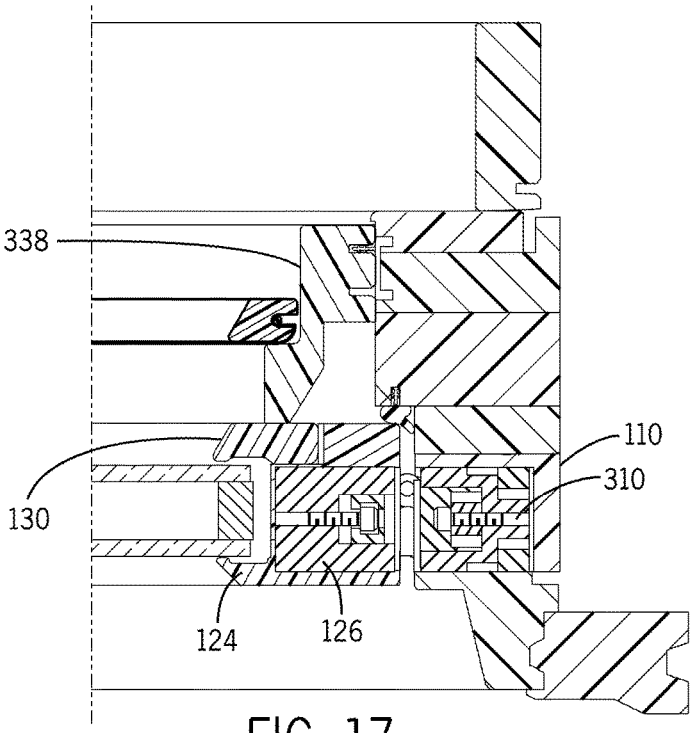
FIG. 17 is a cross-sectional view of the frame assembly along lines 17-17 of FIG. 1 illustrating the hidden sash hinge in the sash and frame assemblies.

Referring to FIG. 17 a cross section of the sash assembly 104 and frame assembly 102 illustrate the hidden nature of hinge assembly 310. When sash assembly 104 is in a closed position relative to frame assembly 102 no portion of hinge assembly 310 is visible to a person viewing the fenestration assembly 100 from inside the structure or from outside the structure. A first portion of hinge assembly 310 is positioned within routed region 120 and the second portion of the hinge assembly 310 is positioned operatively connected to a routed region of second outer frame member 110. In one embodiment hinge assembly 310 is a type of concealed hinge. One such concealed hinge is marketed by Simonswork under the tradename Tectus® one product being TE2403D the features of which are known in the art. Other of the sash components may also provide a routed region to receive a portion of the hinge assembly such as the first outer sash member 124.

Figure 19:
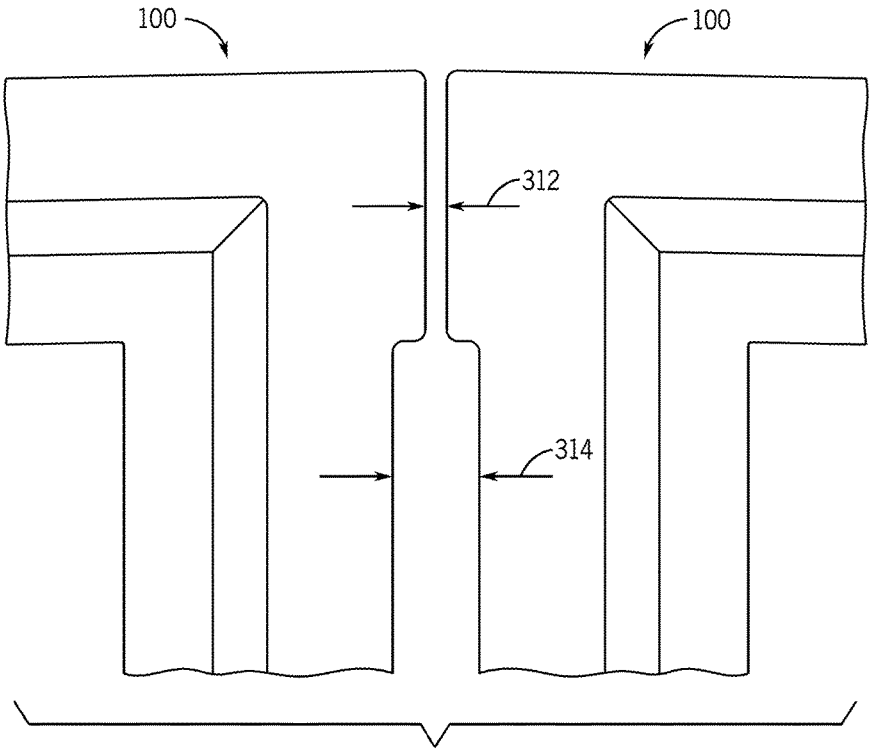
FIG. 19 is a view of two fenestration assemblies mulled together.

Referring to FIG. 19 a first and second fenestration assembly may be mulled together along mating frame portions. In one embodiment the frame is cut and routed in process 166 so that the mating region of the external portions provide a first gap 312 proximate the external portions of the mating assemblies and a second gap 314 having a distance that is greater than the first gap 312. The second gap 314 allow for mating hardware operatively securing each of the fenestrations assemblies to one another to be placed therein and the first gap 312 provides a narrower gap that eliminates the need for additional hardware. First gap 314 be sufficiently narrow enough to be sealed with a standard silicone sealant or other sealant known in the art.

Figure 20:
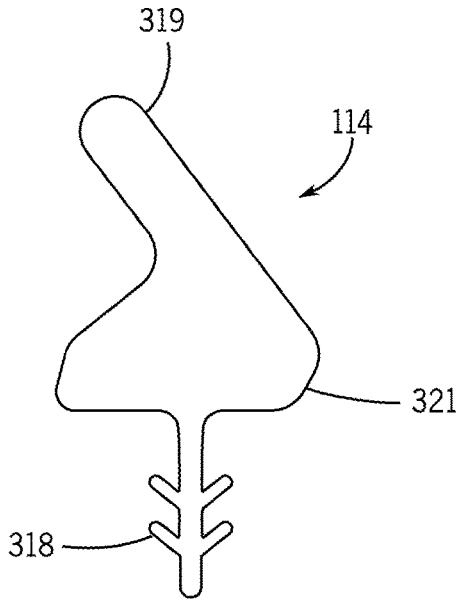
FIG. 20 is a cross section of a weather strip component.

Referring to FIG. 9 and FIG. 20 weather strip 114 is positioned within a groove 316 within fourth inner frame member 116 and extending about the entire periphery of fourth inside frame 116. Weather strip 114 includes a tab portion 318 that is received within groove 316. Weather strip 114 further includes a body 321 having a flexible extension portion 319 extending therefrom that contacts the inner face of second intermediate sash member 126 forming a seal between the inner face of second intermediate sash member 126 and outer face of fourth inner frame member 116. Extension portion 319 is deformed from its relaxed orientation illustrated in FIG. 20 to a sealed position illustrated in FIG. 9 when sash assembly 104 is in the closed orientation relative to frame assembly 102.

The weep path 292 is positioned external to the location of weather strip 114. Since groove 316 is routed into fourth inner frame member 116 which is formed from a single sheet of material including the corners of fourth inner frame member 116 there need not be any discontinuity as the weather strip may be formed from a single continuous piece with two terminal ends that may be affixed or proximate one another.

Weather strip 128 may be three sided or four sided. Referring to FIG. 9 weather strip 128 is positioned within a groove 318 in first outer sash member 124 that extends about the entire periphery of first outer sash member 124. A glazing bead weather strip 132 is positioned within a continuous groove 320 within second intermediate sash member 126 forming a seal between the outer periphery of third sash member 130 and second intermediate sash member 126.

Referring to FIG. 9 other fenestration assembly 100 includes an outer trim member 330 operatively connected to first outer frame member 108. An outer sill member 332 is operatively connected to first outer frame member 108. A plurality of trim jamb extenders may be operatively positioned adjacent fifth inner frame member 118 and a frame fascia cover 336. Referring to FIG. 17 a jamb cover 338 is positioned proximate third inner sash member 130 and operatively connected to fifth inner frame member 118. The outer face of screen assembly 106 contacts a surface of jamb cover 338 to limit movement of screen assembly 106 in the outwardly direction when screen assembly is in the installed in-use position.

Referring to FIG. 9 weather strip 114 is positioned proximate the outer face of fourth frame member 116 such that the third sash member 130, jamb cover 338, inner sill 266, frame fascia members 336 are all within the inner side of weather strip 114. Stated another way, these members are all completely protected from external weather by weather strip 114.

Figure 22:
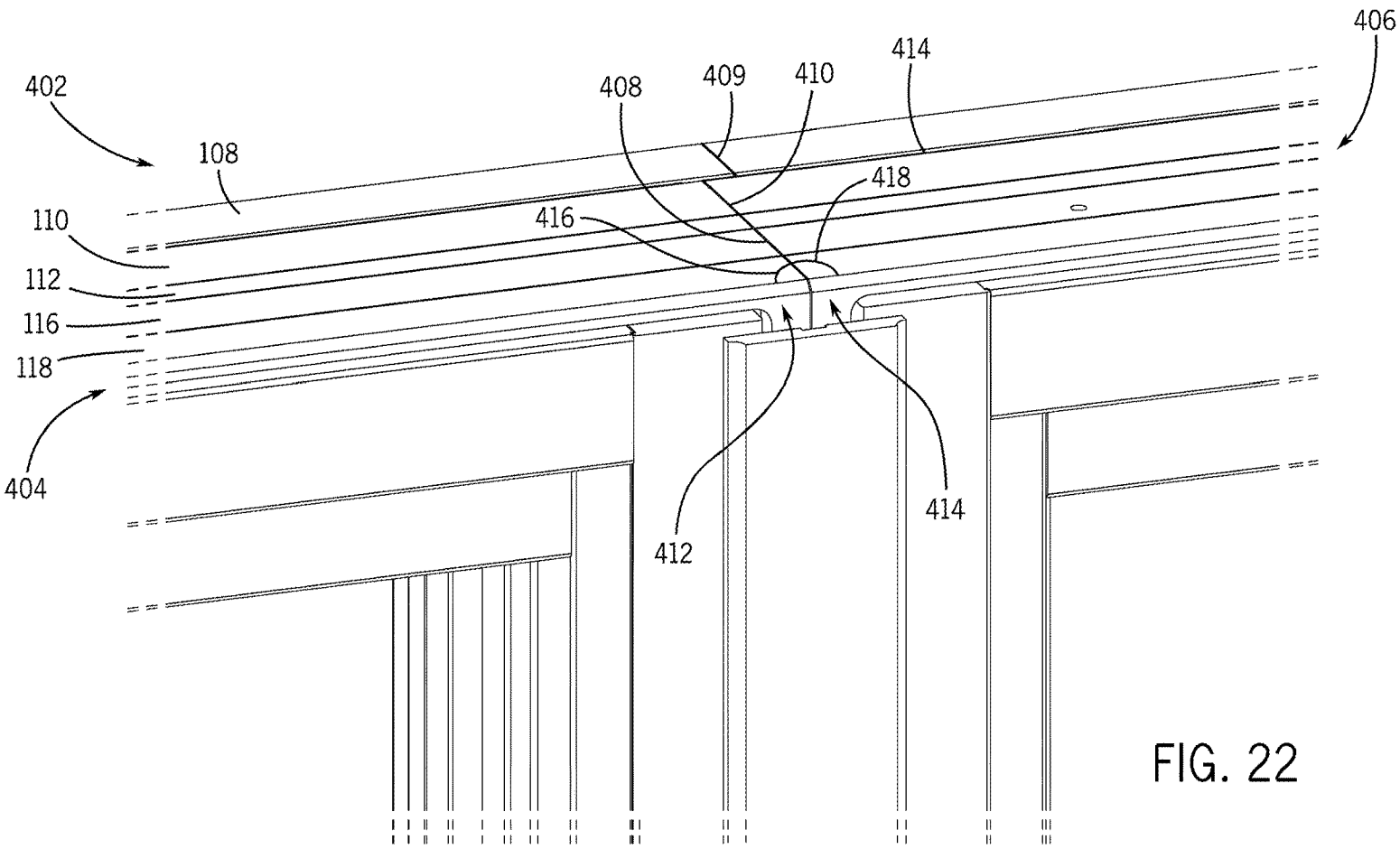
FIG. 22 is a partial isometric view of two mulled fenestration assemblies.

Referring to FIG. 22 two frame assemblies 404 and 406 may be mulled together to form a mulled bay/bow window 402. The forming process 166 may be modified so that the mating portions 408 and 410 of two mulled frame members 404 and 406 respectively have a complimentary angle to form the proper bay/bow mulled windows. Stated another way, the mating portions 408 and 410 have a non-perpendicular angle 416 and 418 to the plane defined by inner face portions 412 and 414 respectively. Such that the planes defined by face portions 412 and 414 are not coplanar when the two frame assemblies 404 and 406 are mulled together. Mating portions 408 and 410 include the mating portions of frame members 108, 110, 112, 116, and 118. In one embodiment first outer frame member 108 of a first fenestration assembly is formed to overlap second outer frame member 110 of the second fenestration assembly. In this manner the interface 411 between corresponding frame members 110, 112, 116 and 118 do not line up with the interface 409 between first outer frame member 108 of the first fenestration assembly and the first outer frame member of the second fenestration assembly.

Figure 23:
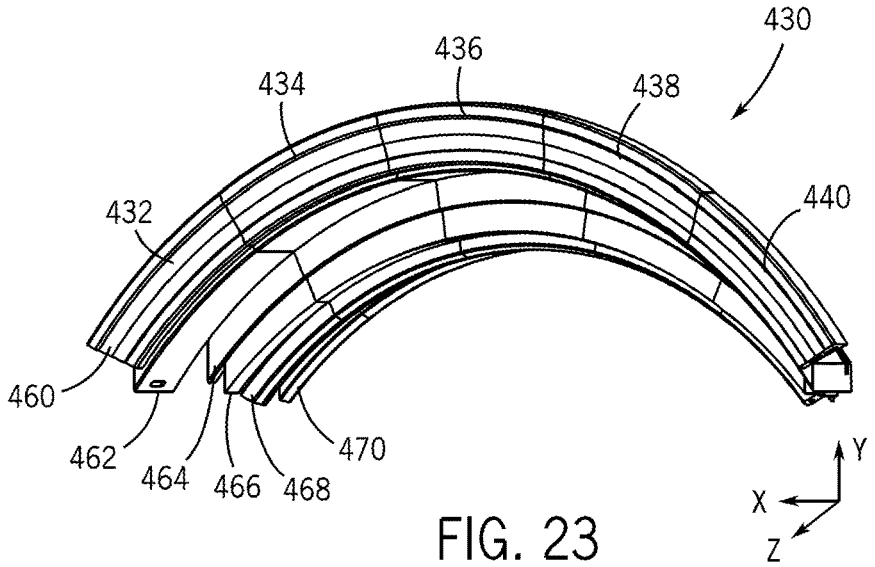
FIG. 23 is an isometric view of a jamb cover header.

Referring to FIG. 23 a jamb cover header may be formed from multiple parts 432, 434, 436, 438 and 440. Each part 432-440 are formed separately from a board and then secured together to form a curved jamb cover header having a compound curvature. Stated another way the curved jamb cover has a curvature in the x-y plane and a radius of curvature in the x-z plane. In one embodiment the curved jamb will have curved features in two or more of the x-y plane, x-z plane and y-z planes.

Figure 25:
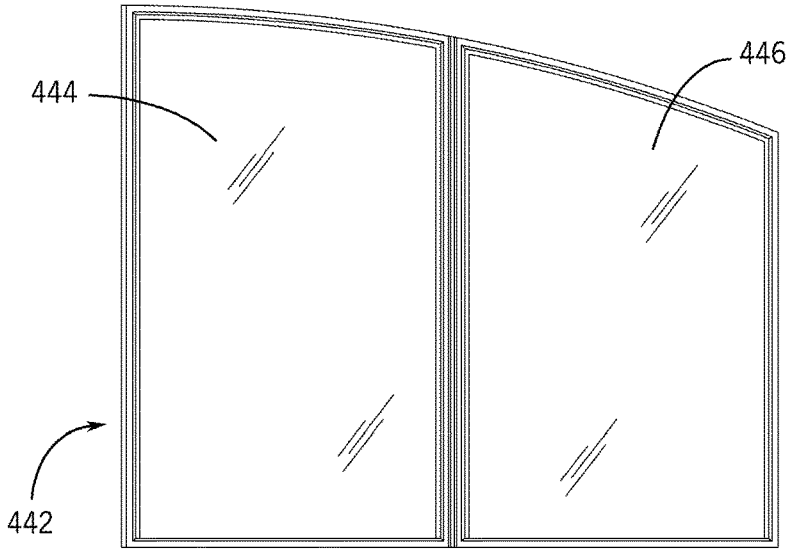
FIG. 25 is a plan view of a continuous mull frame member.
Figure 26:
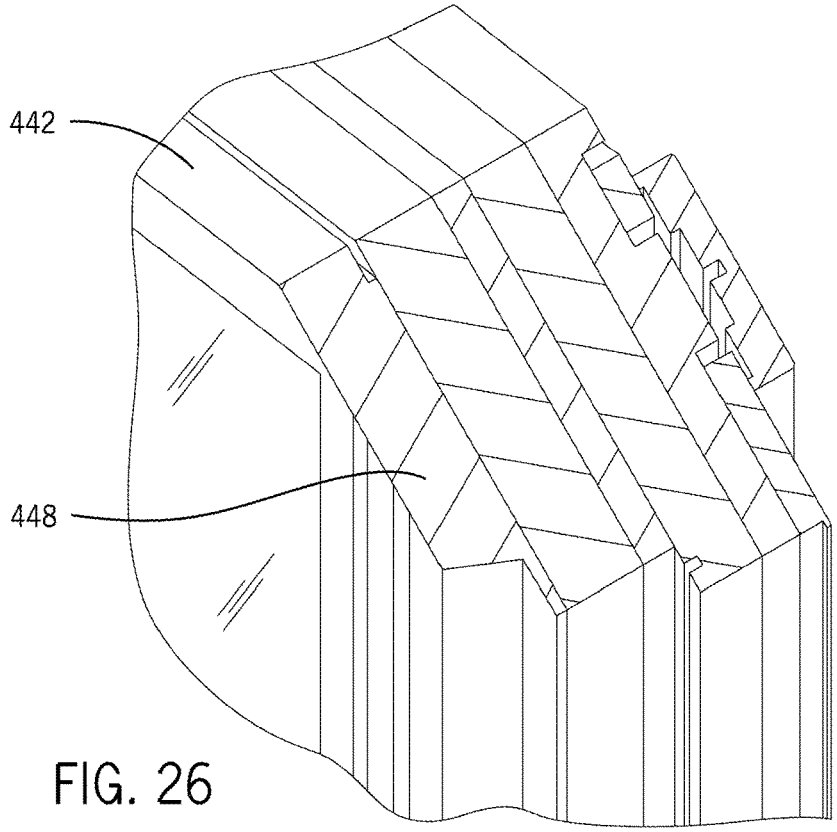
FIG. 26 is a partial cross sectional view of a corner of mulled fenestration assemblies.

Referring to FIG. 25 and FIG. 26 it is possible using process 166 to create a mill frame 442 out of single sheet stock to create multiple openings out of one sheet. Since there are no connectors in the continuous mull 442 there are no opportunity for leaks as there are no interface components being connected to form the mull frame. There is no need for a corner connector as corners 448 are formed from the single sheet stock. FIG. 26 is a cutaway of a corner region of mull frame 443 showing that there is no corner connector reason, so no joint line and no opportunity for leaks of air and/or water.

Figure 29:
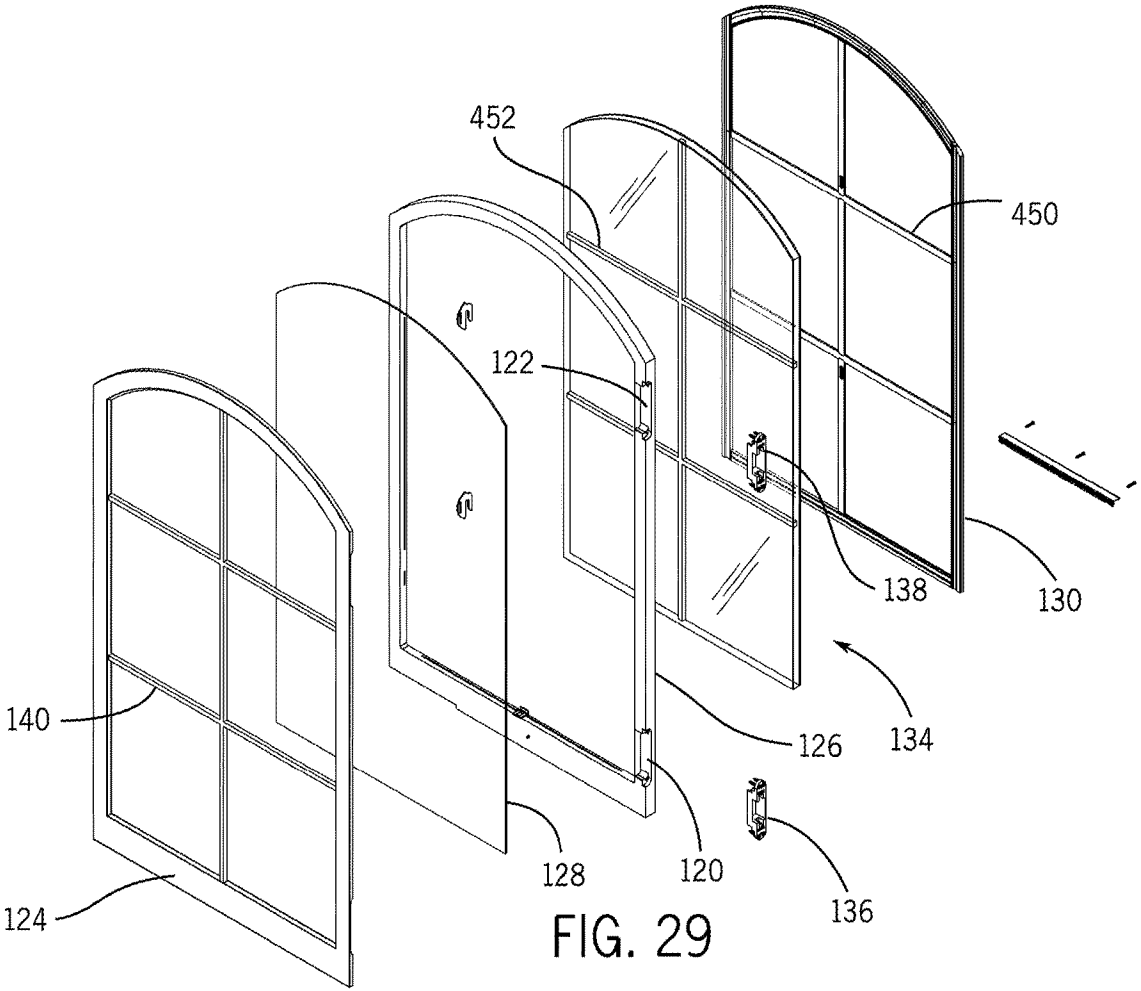
FIG. 29 is an exploded view of the frame assembly.

Referring to FIG. 29 it is possible using the mull connector systems described herein to connect different type of fenestration assemblies. In one embodiment a fenestration formed from phenolic material may be mulled to other fenestration assemblies formed from phenolic material either in the field or factory. In one embodiment a fenestration formed from phenolic materials may be mulled to other fenestration assemblies formed from fiberglass either in the field or factory. In one embodiment a mull frame member such as member 108 may be formed from a continuous one piece of material as outlined herein to cover all of the mulled fenestration assemblies.

Figure 30:
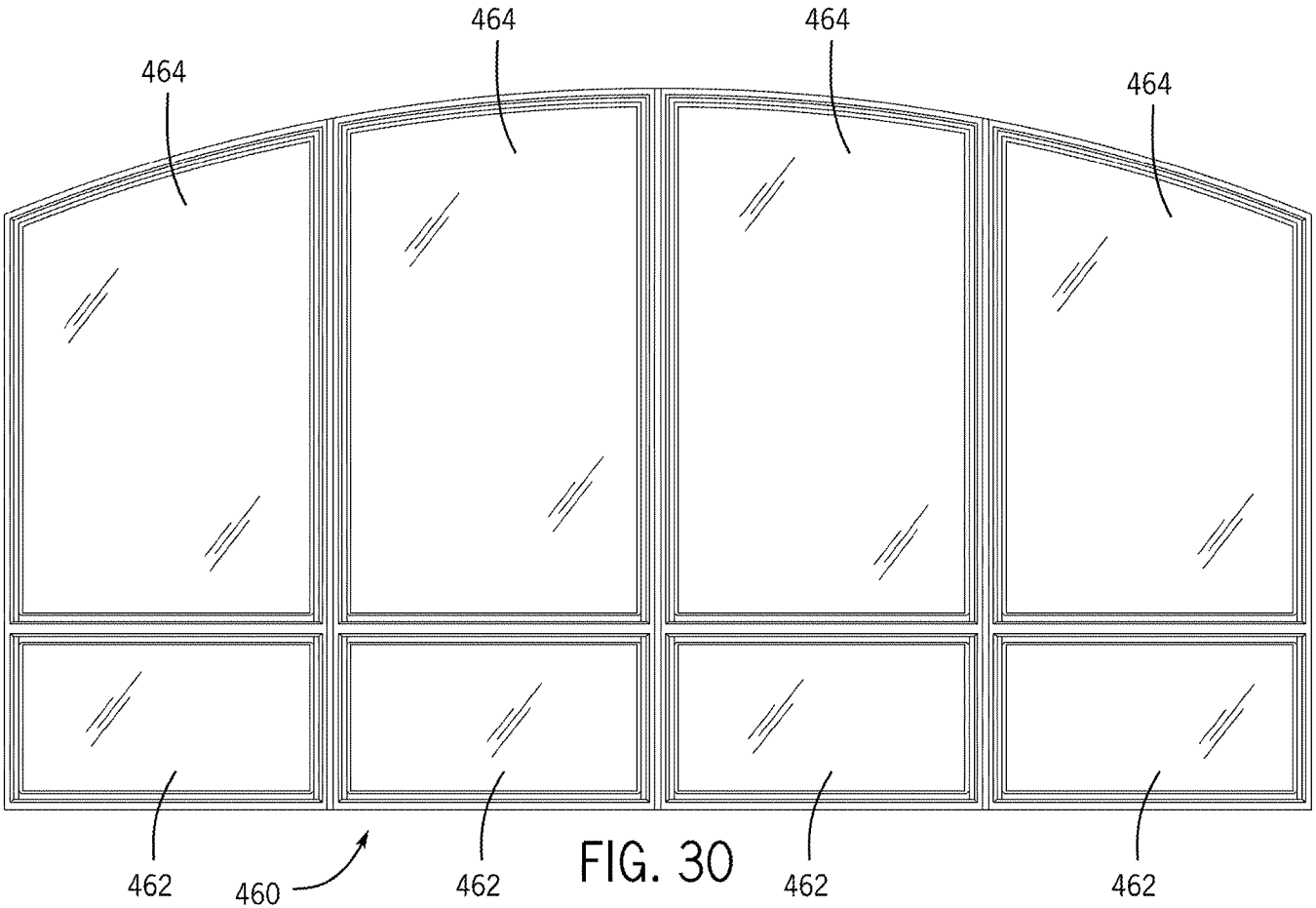
FIG. 30 is a plan view of mulled fenestration assemblies with a connector.
Figure 31:
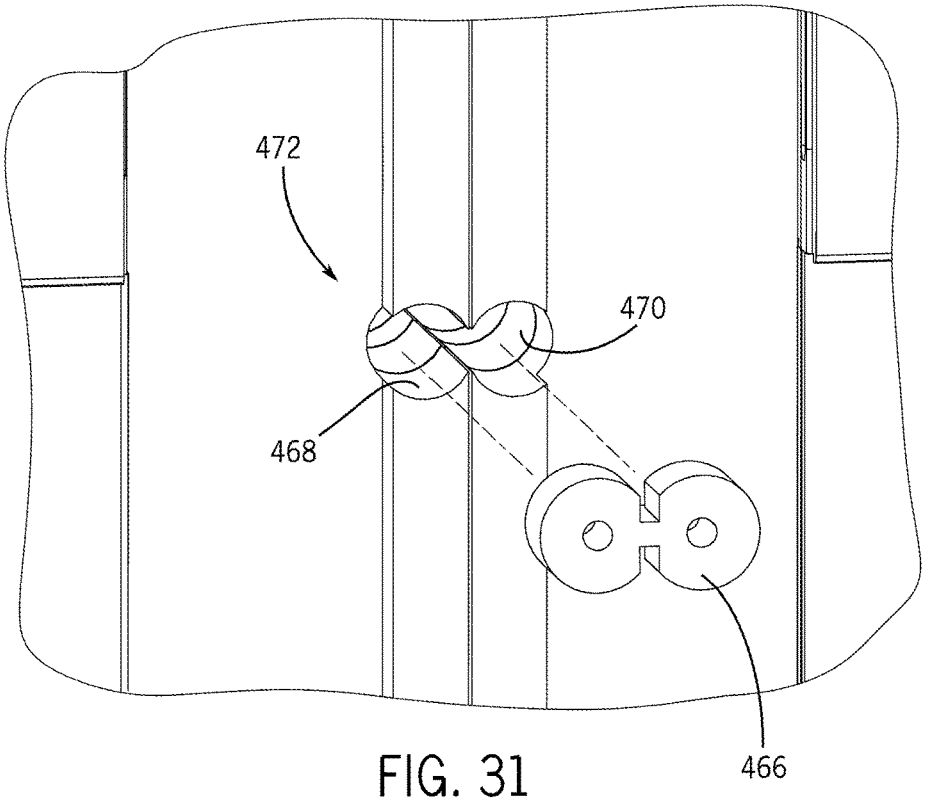
FIG. 31 is an isometric view of mulled fenestration assemblies with a connector.

Referring to FIG. 30 and FIG. 31 a connector 466 is inserted in to routed connector regions 468 and 470 in two separate frame assemblies. Routed regions 468 and 470 are formed in each of the members forming the frame to provide a secure and strong mulled assembly of the two separate frame assemblies. In one embodiment a first connector 466 is positioned on one side of the mull assembly and a second connector 467 is positioned on a second side of the mull assembly. In one embodiment a connector (not shown) extends the entire through the entire two frame assemblies rom an inner side to a region proximate the outer side such that first connector 466 and second connector 467 would be continuous and joined by an intermediate portion (not shown) and a unitary connector.

Figure 27:
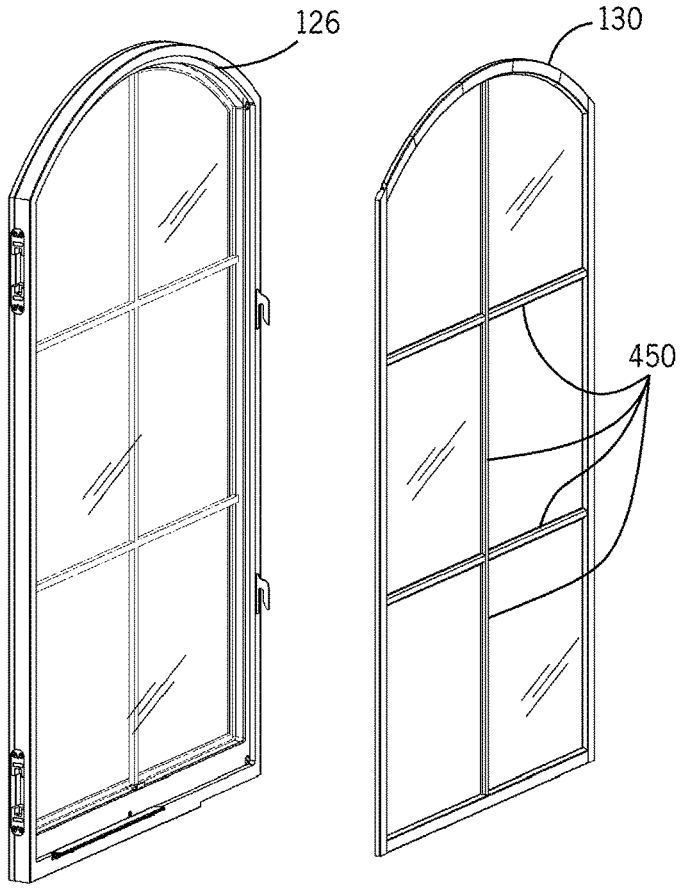
FIG. 27 is an exploded view of a sash glazing bead assembly.
Figure 28:
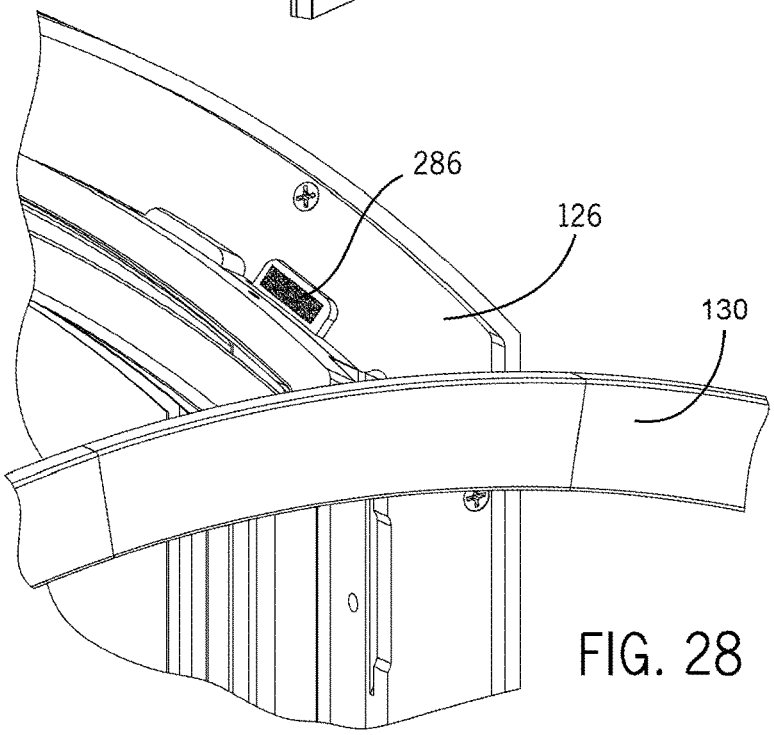
FIG. 28 is an exploded view of a portion of a glazing bead attachment.

Referring to FIG. 27, third inner sash member 130 includes an integrally formed grid 450 that is formed as one piece with third inner sash member 130. The ability to construct grid and third inner sash member 130 sash as one piece ensures alignment with other grids in other sash and/or frame components and allows for simple to complex curved grids. Referring to FIG. 28 a grid 452 may be formed from a single piece of material and be located between two glazings or sheets of glass. In this manner it is possible to align the patters of grid 140 in first sash member 124, grid 452 in the glazing and grip 450 of third inner sash member 130.

Figure 35:
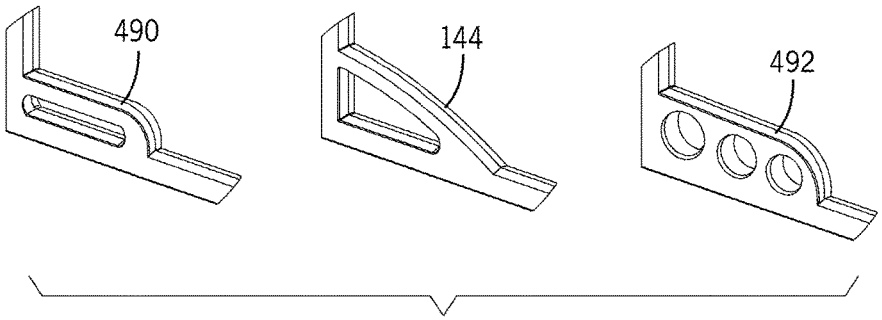
FIG. 35 is an isometric view of various screen handles.
Figure 36:
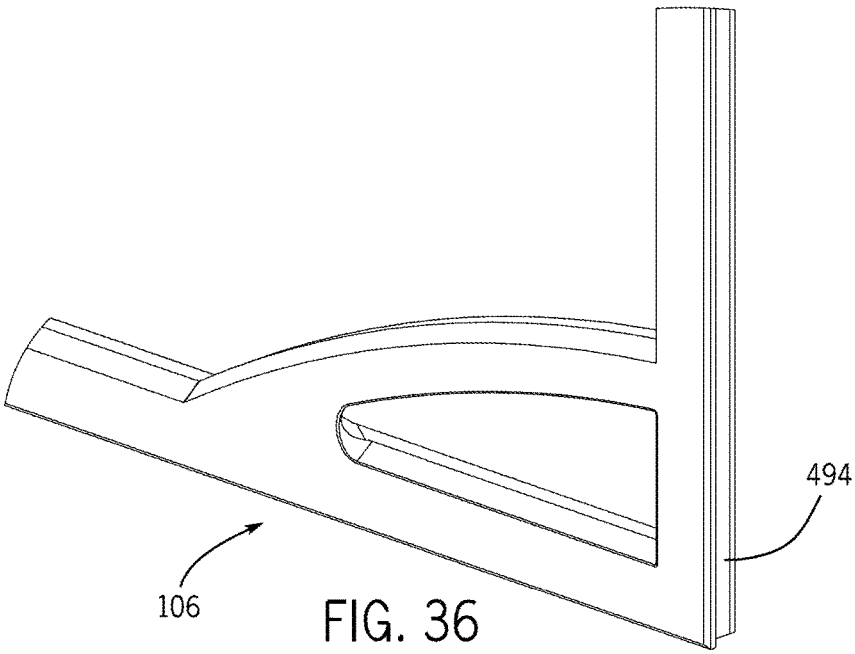
FIG. 36 is a partial isometric view of a screen with a rabbit groove to secure a screen mesh.

In one embodiment grids 140 and 450 may include a recessed region to receive a portion of a dual lock or hook and loop connector that is secured to a corresponding hook or loop portion that is adhered directly to the glazing. In this manner the three grids 140, 452 and 450 will appear to be formed from a single piece of material and not from three separate grids. Referring to FIG. 35 a hook and loop connector 494 such as Dual Lock may be used on the outer periphery of screen 106 that is removably connected to a corresponding portion of the hook and loop connector on the frame assembly. The connector 494 may be located in a groove routed in the outer periphery of the frame in a direction toward screen mesh such that only the outermost portion of connector material 494 extends beyond the outer periphery of the frame member of screen 106 and in such a manner that the connector 494 would not be readily visible by a user viewing the screen from the inside or outside of the structure in which the screen was deployed.

Figure 32:
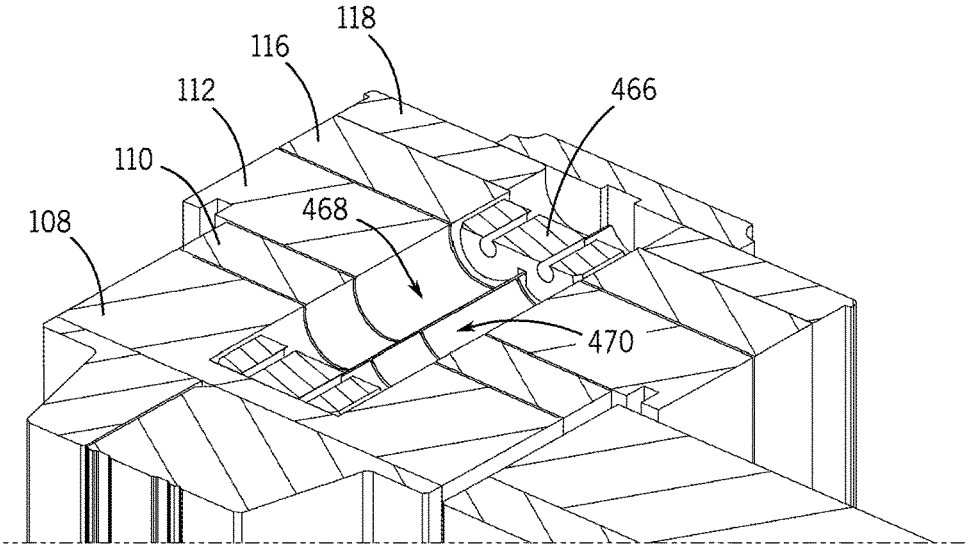
FIG. 32 is a partial cross-section of isometric view of mulled fenestration assemblies.
Figure 33:
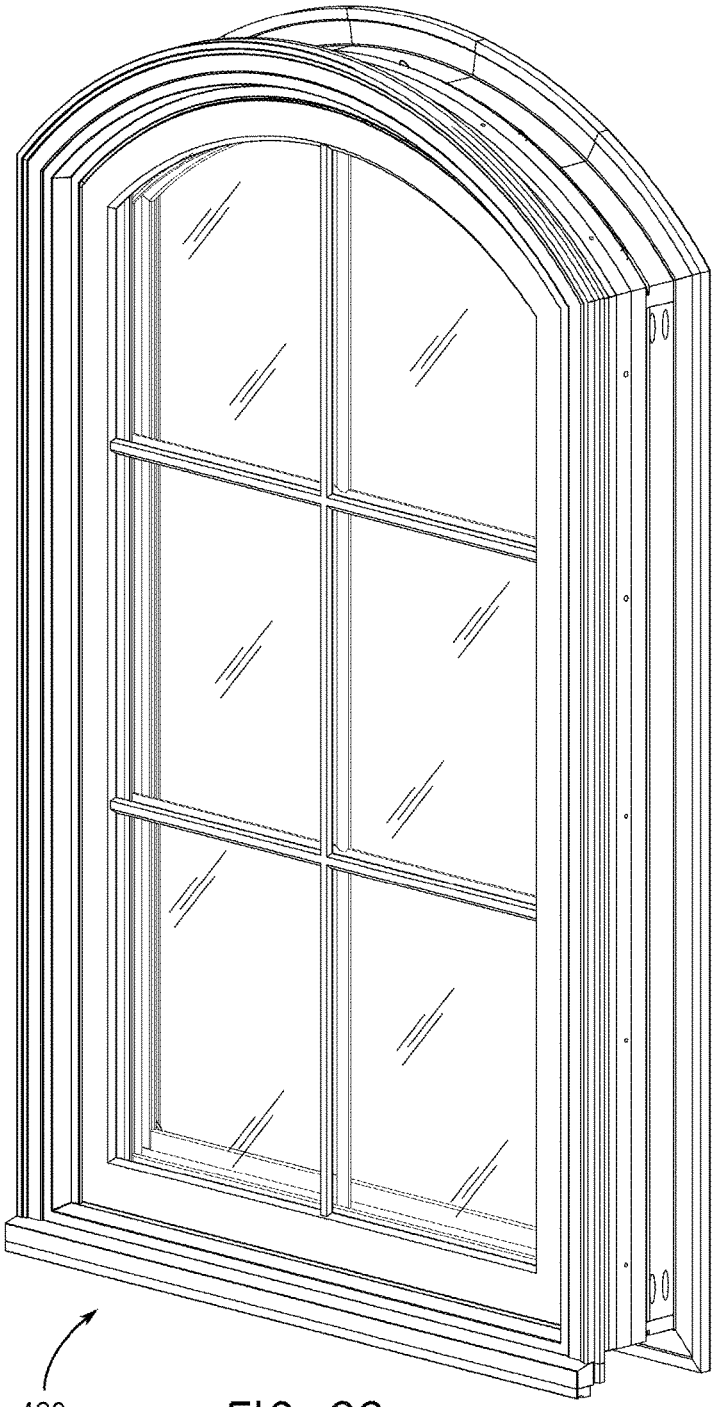
FIG. 33 is an isometric view of a picture window.

Referring to FIG. 32 and FIG. 33A and FIG. 33B in one embodiment the process 166 may be used to create a picture window 480 with a fixed glazing (no moving sash). As illustrated in FIG. 33A and FIG. 33B a picture window is created by combining second intermediate sash member 126 and second outer sash member 110 in the movable sash embodiment with a member 482 formed with process 166 and a member 484 as a thermal layer. Similarly fourth inner frame member 116 is modified as shown by member 486 in this manner it is possible to employ the methods as described herein for manufacturing a frame and movable sash can be used to form picture window 480. Note that member 484 may also be a thermal layer. In one embodiment any of the frame or sash members may be substituted with a material having greater thermal properties than the materials identified above either for the picture window 480 of for frame 102 or sash 104.

Figure 34B:
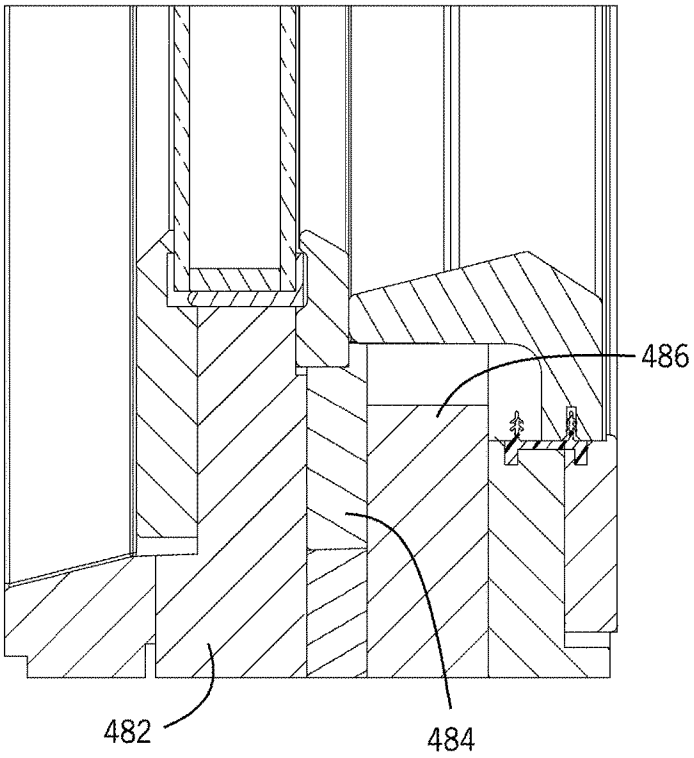
FIG. 34B is a cross sectional view of a picture window.
Figure 34A:
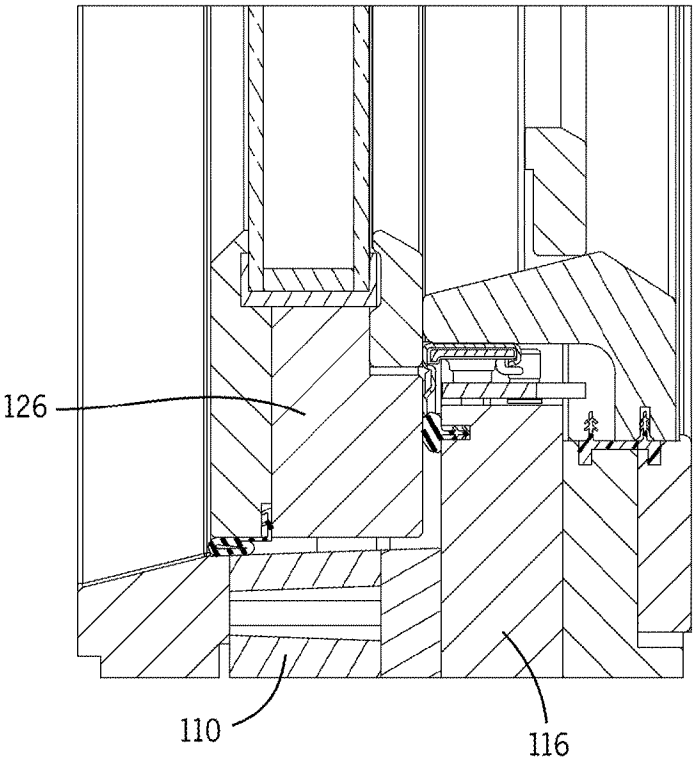
FIG. 34A is a cross sectional view of a frame and sash assembly.

Referring to FIG. 5 and FIG. 34 handle 144 may have various configurations such as handle 490 having a single recess extending therein and handle 492 having a plurality of openings extending therethrough and routed as part of screen frame 106 such that the handle 144 and outer frame 142 are formed from a single sheet of material with not attachments or additional hardware to connect handles portions 144 to the frame 142.

Figure 37:
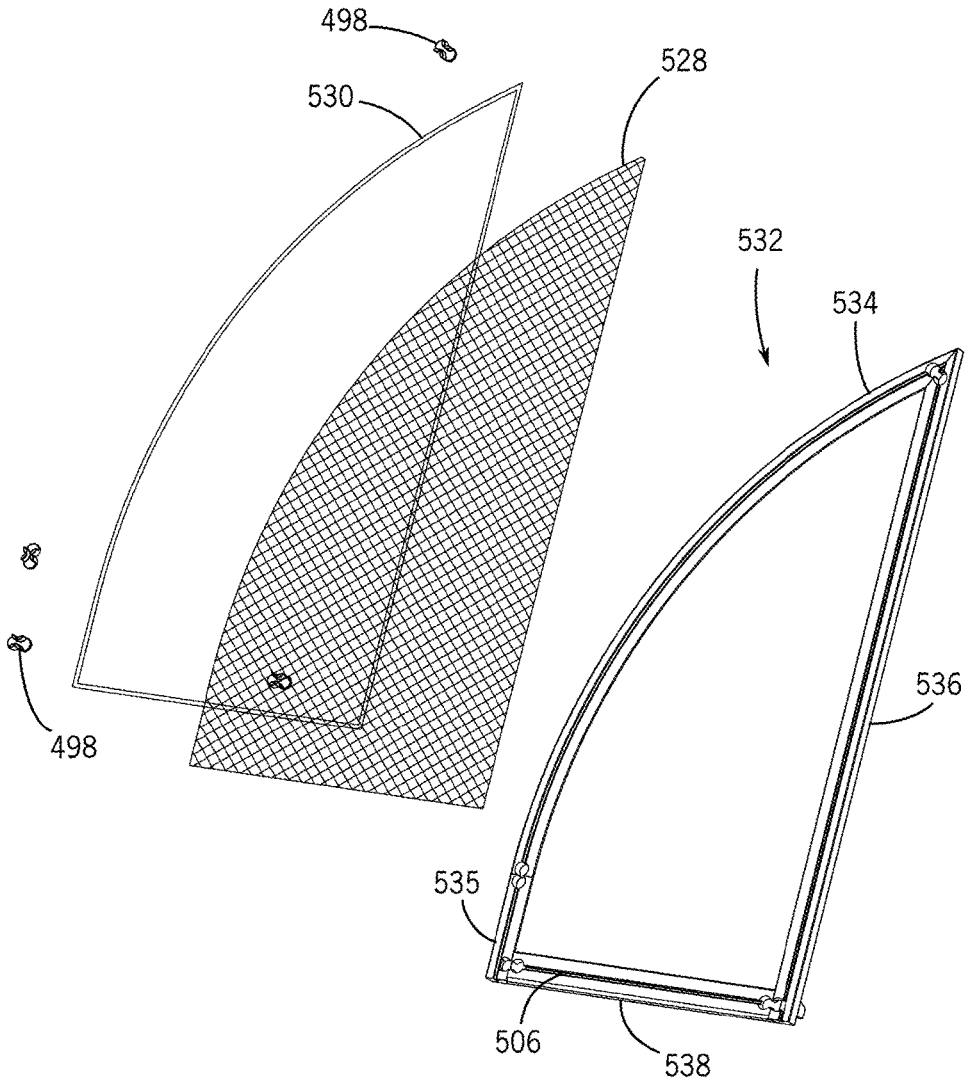
FIG. 37 is an exploded view of a sash frame assembly with a screen member having more than one member.
Figure 38:
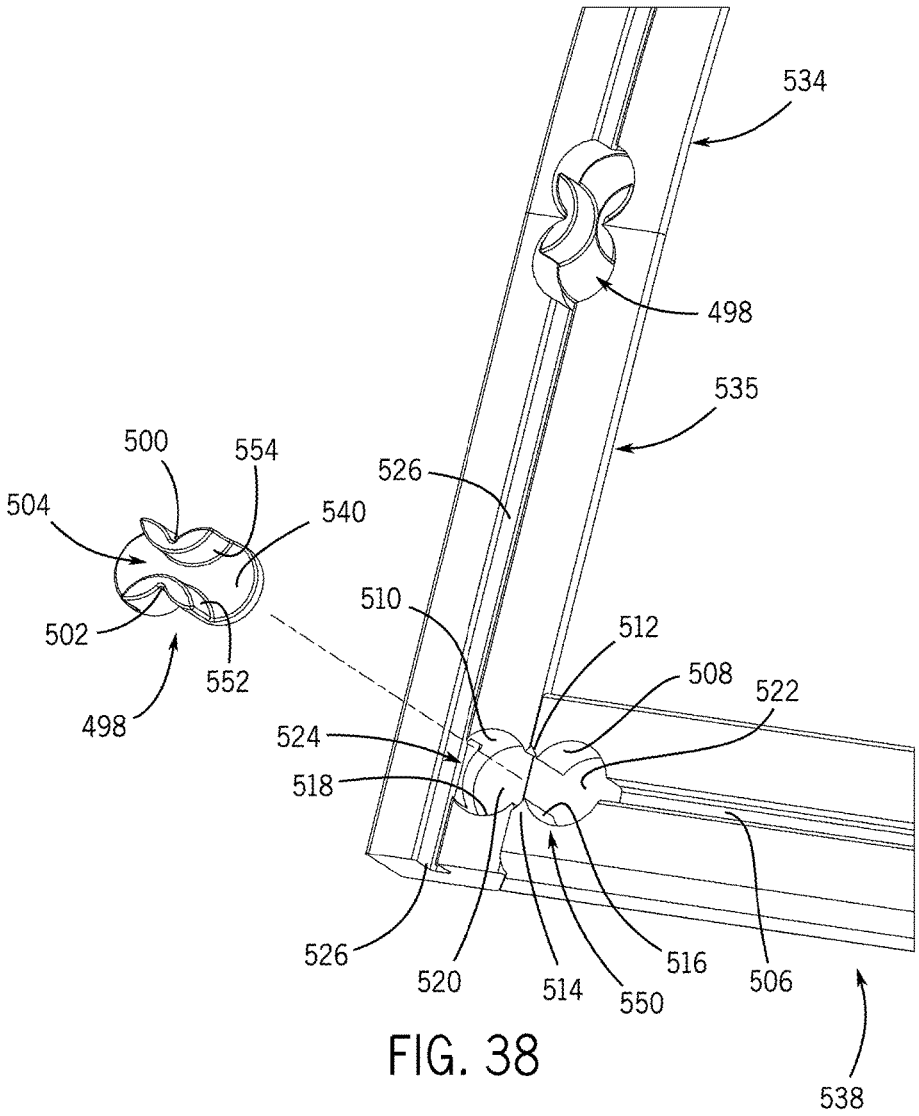
FIG. 38 is a close up view of a connector and screen members of FIG. 37.

Referring to FIG. 37 and FIG. 38 a screen frame 532 may be formed from more than one member. In one embodiment frame 532 is formed from members 534, 536, 538, and 535. Each of members 534, 536, 538 and 535 are secured to one an adjacent member with a connector 498. A spline 530 secures a screen 528 to a channel formed within frame 532. Spline 530 is a continuous member that extends through a channel 504 in connector 498. In one embodiment the channel formed within screen 528 is continuous about the frame with each frame member 534, 536, 538 and 535 having a channel portion. Referring to FIG. 38 member 538 includes a channel 506 that is operatively connected to channel 526 in member 535 via channel 504 in connector 498.

Each member includes a portion of a connector receptacle 550 that receives a portion of connector 498. Referring to FIG. 38 member 538 includes a recessed connector portion 522 and member 535 includes a recessed connector portion 520. Connector portions 522 and 520 form a connector receptacle 550 that operatively receives connector 498 therein. Connector receptacle 550 includes a first non-linear wall portion 508 and a second non-linear wall portion 516 routed in member 5385 that generally corresponds to a portion of the outer geometry of connector 498. Similarly, a third non-linear wall portion 510 and a fourth non-linear wall portion 518 routed in member 535 generally corresponds to a portion of the outer geometry of connector 498. In one embodiment portions 508, 516, 510 and 518 have a concave shape that form a peak or apex 512 and 514 respectively. Connector 498 includes a recess 500 and 502 that correspond to apex 512 and 514 respectively. Connector 498 includes a base 540 that sits within the bottom of the connector receptacle 550 operatively connecting member 538 and 535 together. In one embodiment no additional tools or connector is required to secure connector 498 within connector receptacle 550 and in one embodiment an additional connector such as a fastener or adhesive is sued to secure a connector 498 within each corresponding connector receptacle 550. Connector 498 may be used to connect two members that have a common longitudinal axis such as with member 534 and 535. Connector may also be used to connector two members that do not have a common longitudinal axis such as members 538 and 535. Members that are connected with connector 498 may have longitudinal axis that are perpendicular to one another or may the connectors may have longitudinal axis that are neither perpendicular nor co-linear. Referring to FIG. 37 member 534 may be non-linear such as arcuate and be connected to another linear member 536 with a connector 498 by proper routing of the connector receptacle 550 within members 534 and 536.

In one embodiment grooves 506 and 526 extend from an outside face of frame 532 in an inwardly directly that is generally perpendicular to the outside face of frame 532. However it is also contemplated that grooves 506 and 526 extend from an inside face of frame 532 in an outwardly direction. Using method 166 described above a user forms each of the frame members and routes the connector receptacle regions therein and then assembles the members to one another using connectors 498. Connector 498 may be pressed fit or friction fit with in connector receptacles 550 without any other fastener or adhesive. A user then places spline 530 within the grooves formed within the individual members as well as within channel 504 within each recess securing screen 528 to frame 532. Convex arcuate portions 552 and 554 provide a transition for spline 530 and screen within 528 through channel 504 that also aids when the members connected with connector 498 do not have co-linear longitudinal axis.

It is important to note that the apparatus and methods as described herein are illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. Each of the features described herein may be combined together or used independently with other features described herein in all combinations. One non-limiting example is that screen assemblies 106, 322 and the screen assembly incorporating frame 532 may be used interchangeable with the fenestration assembly described herein and with other fenestration assemblies not described herein. For example, elements shown as integrally formed may be constructed of multiple parts or elements and vice versa, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the exemplary embodiments without departing from the scope of the present inventions as expressed in the appended claims.

What is claimed is:

1. A fenestration assembly comprising:

a frame assembly, and a sash assembly;

the frame assembly includes a first unitary frame member formed from a continuous first sheet of material;

the sash assembly including at least one unitary member being formed from a second single sheet of material;

wherein the one unitary member of the sash assembly includes an outer face and an opposing inner face; a first periphery extending between the outer face and the inner face, and a second periphery spaced radially inwardly from the first periphery and defining an open region, a weep path extends from a second opening in the second periphery to a first opening in the first periphery;

wherein the weep path is defined by a path extending from the second opening in the outer face toward the inner face; the path including a first sloped region terminating in a bottom portion and a second portion extending from the bottom portion toward and terminating at the first opening in the first periphery; wherein water in the weep path remains in the region between the first region and the second region proximate the bottom portion.

2. The fenestration assembly of claim 1, further including a hinge operatively connecting the sash assembly to the frame assembly to move the sash assembly from an open position relative to the frame to a closed position relative to the frame, the hinge being completely hidden when the sash is in the closed position.

3. The fenestration assembly of claim 1, including a weather strip being operatively secured to a groove in the unitary frame member, wherein the groove extends inwardly into the unitary frame member and continuously about an opening, the weather strip being positioned external to a glazing bead operatively coupled to the unitary sash member.

4. The fenestration assembly of claim 1 wherein the sash assembly includes a second unitary frame member having a grill integrally formed therein.

5. The fenestration assembly of claim 1, wherein the sash assembly includes a glazing clip operatively securing a glazing assembly adjacent a first outer frame member relative to a second frame member.

6. The fenestration assembly of claim 1 further including a screen assembly including a screen frame and a screen mesh member connected to the screen frame with a hook material operatively attached to the screen frame and fitting through a plurality of openings in the periphery of the screen mesh material.

7. The fenestration assembly of claim 1 further including a second unitary sash member being removably coupled to the first unitary sash member with a hook and loop material.

8. The fenestration assembly of claim 7, wherein the second unitary sash member includes a glazing bead.

9. The fenestration assembly of claim 1, further including a second frame assembly having a first side portion being mulled to a second side portion of the first frame assembly, the first frame assembly and second mulled assembly when adjacent one another forming a first gap having a first distance proximate an exterior portion of the first frame assembly and an exterior portion of the second frame assembly and defining a second gap having a second distance that is greater than the first distance.

10. The fenestration assembly of claim 9, further in including hardware positioned within the second gap operatively securing the first and second fenestrations assemblies to one another and wherein a sealant is provided in the first gap.

11. The fenestration assembly of claim 1 further including a screen assembly having a screen frame including an outer periphery having a groove extending therein and a screen having an outer periphery being positioned within the groove and operatively secured to the screen frame with a spline.

12. The fenestration assembly of claim 1, wherein the sash includes a plurality of corners wherein the second single sheet of material includes more than one continuous unitary material portion glued together along respective connecting lines spaced from each corner.

13. The fenestration assembly of claim 1, the sash having a plurality of corners, the second single sheet including more than one continuous portion glued together at respective connecting lines spaced from each corner, each corner being located within only one of portions.

14. A fenestration assembly comprising:

a frame assembly, and a sash assembly;

the frame assembly includes at least one each unitary frame member formed from a first sheet of material;

the sash assembly including at least one unitary member being formed from a second single sheet of material further including an arcuate header having an arcuate groove formed therein removably receiving an arcuate portion of a screen assembly, and an inner sill member operatively connected to the frame assembly, the inner sill member including a first upwardly extending slope region and a second downwardly extending slope region being separated by an apex, the screen assembly being moved up and over the apex from the first slope region to the second slope;

wherein the header groove has a first depth proximate a center of the arcuate portion and a second depth a distance from the center of the arcuate portion, wherein the first depth is greater than the second depth.

15. The fenestration assembly of claim 14 further including, at least one biasing member positioned within the groove to provide a biasing force to the screen assembly in an installed position.

16. The fenestration assembly of claim 14, wherein the header overlaps a center portion of the screen frame a first distance and the header overlaps another portion of the screen frame a second distance less than the first distance.

17. A fenestration assembly comprising:

a frame assembly, and a sash assembly;

the frame assembly includes a first unitary frame member formed from a continuous first sheet of material;

the sash assembly including at least one unitary member being formed from a second single sheet of material;

a screen assembly including a screen frame and a screen mesh member connected to screen frame with a hook material operatively attached to the screen frame and fitting through a plurality of openings in the periphery of the screen mesh material;

an inner sill member operatively connected to the frame assembly, the inner sill member including a first upwardly extending slope region and a second downwardly extending slope region being separated by an apex, the screen assembly being moved up and over the apex from the first slope region to the second slope region and being held in the frame assembly by a biasing force of the biasing member.

18. A fenestration assembly comprising:

a frame assembly, and a sash assembly;

the frame assembly includes at least one each unitary frame member formed from a first sheet of material;

the sash assembly including at least one unitary member being formed from a second single sheet of material;

a hinge operatively connecting the sash assembly to the frame assembly to move the sash assembly from an open position relative to the frame to a closed position relative to the frame, the hinge being completely hidden when the sash is in the closed position;

a weather strip being operatively secured to a groove in the unitary frame member, wherein the groove extends inwardly into the unitary frame member and continuously about an opening, the weather strip being positioned external to a glazing bead operatively coupled to the unitary sash member;

a second unitary frame member having a grill integrally formed therein;

an arcuate header having an arcuate groove formed therein removably receiving an arcuate portion of a screen assembly, and at least one biasing member positioned within the groove to provide a biasing force to the screen assembly in an installed position, the header groove having a first depth proximate a center of the arcuate portion and a second depth a distance from the center of the arcuate portion, wherein the first depth is greater than the second depth;

an inner sill member operatively connected to the frame assembly, the inner sill member including a first upwardly extending slope region and a second downwardly extending slope region being separated by an apex, the screen assembly being moved up and over the apex from the first slope region to the second slope region and being held in the frame assembly by a biasing force of the biasing member;

a glazing clip operatively securing a glazing assembly adjacent a first outer frame member relative to a second frame member;

a screen assembly including a screen frame and a screen mesh member connected to screen frame with a hook material operatively attached to the screen frame and fitting through a plurality of openings in the periphery of the screen mesh material;

the unitary member of the sash assembly including an outer face and an opposing inner face; a first periphery extending between the outer face and the inner face, and a second periphery spaced radially inwardly from the first periphery and defining an open region, a weep path extends from a second opening in the second periphery to a first opening in the first periphery; wherein the weep path is defined by a path extending from the second opening in the outer face toward the inner face; the path including a first sloped region terminating in a bottom portion and a second portion extending from the bottom portion toward and terminating at the first opening in the first periphery; wherein water in the weep path remains in the region between the first region and the second region proximate the bottom portion; and a second unitary sash member being removably coupled to the first unitary sash member with a hook and loop material.

* * * * *